US011130337B2

(12) United States Patent
Munakata

(10) Patent No.: US 11,130,337 B2
(45) Date of Patent: Sep. 28, 2021

(54) LIQUID EJECTING HEAD AND LIQUID EJECTING APPARATUS

(71) Applicant: SEIKO EPSON CORPORATION, Tokyo (JP)

(72) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 34 days.

(21) Appl. No.: 16/727,288

(22) Filed: Dec. 26, 2019

(65) Prior Publication Data

US 2020/0207088 A1 Jul. 2, 2020

(30) Foreign Application Priority Data

Dec. 27, 2018 (JP) ..... JP2018-244287

(51) Int. Cl.
*B41J 2/145* (2006.01)
*B41J 2/14* (2006.01)

(52) U.S. Cl.
CPC ..... *B41J 2/145* (2013.01); *B41J 2/14201* (2013.01)

(58) Field of Classification Search
CPC .... B41J 2/145; B41J 2/14201; B41J 2/14233; B41J 2002/14491; B41J 2002/14362; B41J 2002/14241; B41J 2002/14419; B41J 2/01
See application file for complete search history.

(56) References Cited

U.S. PATENT DOCUMENTS 7,963,633 B2 * 6/2011 Oikawa ..... B41J 2/1404 347/47
2015/0042726 A1 2/2015 Enomoto et al.
2016/0339700 A1 11/2016 Kodoi et al.
2017/0282558 A1 10/2017 Miyajima
2018/0029364 A1 2/2018 Seki et al.

FOREIGN PATENT DOCUMENTS

| | | |
|---|---|---|
| JP | H07-108687 | 4/1995 |
| JP | H11-070673 | 3/1999 |
| JP | 2013-039762 | 2/2013 |
| JP | 2015-033838 | 2/2015 |
| JP | 2016-196169 | 11/2016 |
| JP | 2016-215546 | 12/2016 |
| JP | 2017-177442 | 10/2017 |
| JP | 2018-016028 | 2/2018 |

OTHER PUBLICATIONS

IP.com search (Year: 2021).*

* cited by examiner

*Primary Examiner* — Lisa Solomon
(74) *Attorney, Agent, or Firm* — Workman Nydegger

(57) ABSTRACT

A liquid ejecting head includes a first-nozzle-row set in which a pair of first-nozzle-rows is disposed in a second direction intersecting a first direction so that the first-nozzle-rows are symmetrical about a reference line extending in the first direction and a second-nozzle-row set in which a pair of second-nozzle-rows is disposed in the second direction so that the second-nozzle-rows are symmetrical about the reference line. In the second direction, the distance between the second-nozzle-rows is longer than the distance between the first-nozzle-rows. First nozzles constituting the first-nozzle-row set communicate with a first liquid supply source via a first supply flow path. Second nozzles constituting the second-nozzle-row set communicate with a second liquid supply source via a second supply flow path. Compliance capacity of the second supply flow path is larger than compliance capacity of the first supply flow path.

16 Claims, 14 Drawing Sheets

LIQUID EJECTING HEAD AND LIQUID EJECTING APPARATUS

The present application is based on, and claims priority from JP Application Serial Number 2018-244287, filed Dec. 27, 2018, the disclosure of which is hereby incorporated by reference herein in its entirety.

BACKGROUND

1. Technical Field

The present disclosure relates to a liquid ejecting head and a liquid ejecting apparatus including the liquid ejecting head.

2. Related Art

In a liquid ejecting apparatus known in the related art, printing onto a medium such as paper is performed by ink being ejected onto the medium from a liquid ejecting head mounted on a carriage reciprocating in a main scanning direction (for example, JP-A-2013-039762).

A known example of the liquid ejecting head is provided with a plurality of head main bodies having nozzle rows ejecting liquids and a flow path member for supplying a liquid to a corresponding one of the head main bodies from a liquid supply source such as an ink cartridge. Each of the head main bodies is provided with nozzle rows in which nozzles ejecting ink droplets are arranged in parallel in a direction intersecting the main scanning direction of the carriage. The nozzle rows are arranged in parallel in the main scanning direction of the carriage.

The liquid ejecting apparatus described in JP-A-2013-039762 includes a liquid ejecting head having eight nozzle rows. In the liquid ejecting head, a nozzle row (first row) ejecting yellow ink, a nozzle row (second row) ejecting cyan ink, a nozzle row (third row) ejecting magenta ink, a nozzle row (fourth row) ejecting black ink, a nozzle row (fifth row) ejecting black ink, a nozzle row (sixth row) ejecting magenta ink, a nozzle row (seventh row) ejecting cyan ink, and a nozzle row (eighth row) ejecting yellow ink are sequentially arranged in the main scanning direction. In other words, the nozzle rows that eject ink of the same color are disposed so as to be symmetrical about the space between the fourth nozzle row and the fifth nozzle row, that is, about the center of the eight nozzle rows, and a flow path member or the like is configured such that each of the nozzle rows ejecting ink of the same color is supplied with the corresponding ink of the same color.

The liquid ejecting apparatus having such a liquid ejecting head performs recording operation while causing the liquid ejecting head to reciprocate in the main scanning direction relative to the medium. As a result, the order of landing of the ink of each color with respect to the medium can be aligned in forward and return paths and high-quality printing can be performed.

In a flow path member through which ink is supplied to a plurality of nozzle rows, the ink is supplied to the symmetrically disposed nozzle rows by a flow path, through which the ink supplied from a liquid supply source storing the ink of each color flows, branching in the middle (for example, JP-A-2015-033838).

In the liquid ejecting apparatus described in JP-A-2013-039762, the nozzle rows as the pair that eject ink of the same color (hereinafter, referred to as the nozzle row set) are symmetrically arranged for each color, and thus the inter-nozzle row distance in the nozzle row set is different for each nozzle row set. For example, when the nozzle row ejecting the yellow ink is located at the outermost position and the nozzle row ejecting the black ink is located at the innermost position in the main scanning direction, the distance between the nozzle rows ejecting the yellow ink is the longest and the distance between the nozzle rows ejecting the black ink is the shortest.

For example, when ink is ejected from the nozzle row set during a carriage movement to the positive side in the main scanning direction, the ink is ejected first from the nozzle row positioned on the positive side in the main scanning direction and the ink is ejected later from the nozzle row positioned on the negative side in the main scanning direction. Accordingly, in the nozzle row set ejecting ink of the same color, the difference between the timing at which the nozzle row from which ink is ejected first starts ink ejection and the timing at which the nozzle row from which ink is ejected later starts ink ejection (hereinafter, referred to as the timing difference in the nozzle row set) becomes relatively large in the nozzle row set having a long inter-nozzle row distance than in the nozzle row set having a short inter-nozzle row distance.

As for the pair of nozzle rows constituting the nozzle row set, the ink stored in the liquid supply source is distributed and supplied to the pair of nozzle rows via a supply flow path, and thus the negative pressure that results from ink ejection by the nozzle row that has first started ink ejection acts on the supply flow path and is accumulated in the supply flow path until the nozzle row later starting ink ejection starts ink ejection. Accordingly, when the timing difference in the nozzle row set is large, a larger negative pressure acts on the nozzle row later starting ink ejection as compared to when the timing difference in the nozzle row set is small. Accordingly, ink discharge may become unstable and problems such as defective printing may arise in the nozzle row later starting ink ejection.

SUMMARY

A liquid ejecting head of the present application includes a first pressure chamber communicating with a nozzle ejecting a first liquid, a second pressure chamber communicating with a nozzle ejecting a second liquid, a nozzle row in which a plurality of the nozzles is disposed in a first direction, a first supply flow path through which the first liquid is supplied from a first liquid supply source to the first pressure chamber, a second supply flow path through which the second liquid is supplied from a second liquid supply source to the second pressure chamber, a first nozzle row set in which a pair of the nozzle rows is disposed in a second direction intersecting the first direction so that the nozzle rows are symmetrical about a reference line extending in the first direction, and a second nozzle row set in which a pair of the nozzle rows is disposed in the second direction so that the nozzle rows are symmetrical about the reference line and the interval between the nozzle rows is longer than in the first nozzle row set. The plurality of nozzles constituting the first nozzle row set communicates with the first liquid supply source via the first supply flow path. The plurality of nozzles constituting the second nozzle row set communicates with the second liquid supply source via the second supply flow path. Compliance capacity of the second supply flow path is larger than compliance capacity of the first supply flow path.

A liquid ejecting head of the present application includes a first pressure chamber communicating with a nozzle ejecting a first liquid, a second pressure chamber communicating with a nozzle ejecting a second liquid, a nozzle row in which a plurality of the nozzles is disposed in a first direction, a first supply flow path through which the first liquid is supplied from a first liquid supply source to the first pressure chamber, a second supply flow path through which the second liquid is supplied from a second liquid supply source to the second pressure chamber, a first nozzle row set in which a pair of the nozzle rows is disposed in a second direction intersecting the first direction so that the nozzle rows are symmetrical about a reference line extending in the first direction, and a second nozzle row set in which a pair of the nozzle rows is disposed in the second direction so that the nozzle rows are symmetrical about the reference line and the interval between the nozzle rows is longer than in the first nozzle row set. The plurality of nozzles constituting the first nozzle row set communicates with the first liquid supply source via the first supply flow path. The plurality of nozzles constituting the second nozzle row set communicates with the second liquid supply source via the second supply flow path. Flow path resistance of the second supply flow path is smaller than flow path resistance of the first supply flow path.

In the liquid ejecting head described above, compliance capacity of the second supply flow path may be larger than compliance capacity of the first supply flow path.

The liquid ejecting head described above may further include a head main body provided with the nozzles and a flow path member disposed upstream of the head main body, the first supply flow path may have, in the head main body, a first common flow path communicating with a plurality of the first pressure chambers, the second supply flow path may have, in the head main body, a second common flow path communicating with a plurality of the second pressure chambers, the first common flow path may have a first compliance portion made of a flexible member, the second common flow path may have a second compliance portion made of a flexible member, and an area of the second compliance portion may be larger than an area of the first compliance portion.

The liquid ejecting head described above may further include a head main body provided with the nozzles and a flow path member disposed upstream of the head main body, the first supply flow path may have, in the head main body, a first common flow path communicating with a plurality of the first pressure chambers, the second supply flow path may have, in the head main body, a second common flow path communicating with a plurality of the second pressure chambers, and a cross-sectional area of the second common flow path may be larger than a cross-sectional area of the first common flow path when seen from the first direction.

The liquid ejecting head described above may further include a head main body provided with the nozzles and a flow path member disposed upstream of the head main body, and the second supply flow path may have, outside the head main body, a third compliance portion made of a flexible member.

The liquid ejecting head described above may further include a head main body provided with the nozzles and a flow path member disposed upstream of the head main body, the first supply flow path may include a first liquid flow path provided in the flow path member, the second supply flow path may include a second liquid flow path provided in the flow path member, and the surface of the second liquid flow path perpendicular to the flow direction of the second liquid may be larger in area than the surface of the first liquid flow path perpendicular to the flow direction of the first liquid.

In the liquid ejecting head described above, the first supply flow path may have a first filter, the second supply flow path may have a second filter, and the second filter may be larger in area than the first filter.

In the liquid ejecting head described above, a color of the first liquid may be different from a color of the second liquid.

A liquid ejecting apparatus of the present application includes the liquid ejecting head, a carriage reciprocating in the second direction with the liquid ejecting head mounted, a first liquid supply source in which the first liquid is stored, and a second liquid supply source in which the second liquid is stored.

DESCRIPTION OF EXEMPLARY EMBODIMENTS

Figure 1:
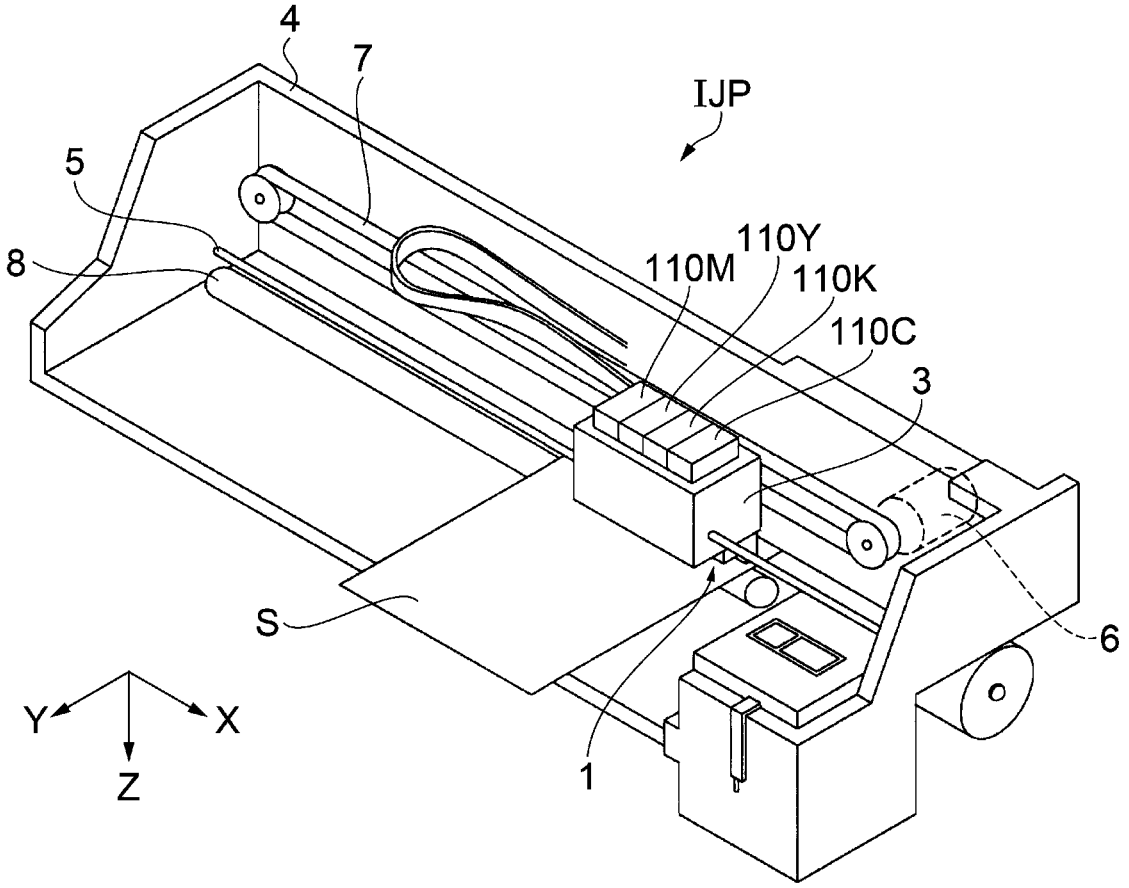
FIG. 1 is a perspective view of a liquid ejecting apparatus according to an embodiment.

Hereinafter, an embodiment of the present disclosure will be described with reference to the drawings. The embodiment illustrates an aspect of the present disclosure, does not limit this disclosure, and can be changed appropriately within the scope of the technical idea of the present disclosure. The scales of layers and members in the drawings are different from actual scales and this is for the layers and the members to be recognizable in terms of size.

Embodiment

FIG. 1 is a perspective view of a liquid ejecting apparatus IJP according to the embodiment. First, a schematic configuration of the liquid ejecting apparatus IJP according to the present embodiment will be described with reference to FIG. 1.

In the following description, the width direction of the liquid ejecting apparatus IJP will be referred to as the X direction, the depth direction of the liquid ejecting apparatus IJP will be referred to as the Y direction, and the height direction of the liquid ejecting apparatus IJP will be referred to as the Z direction. The X direction and the Y direction are directions along a horizontal plane. The Z direction is a gravity direction orthogonal to the horizontal plane. Further, the distal end sides of direction-indicating arrows will be defined as +directions and the proximal end sides of the direction-indicating arrows will be defined as −directions. Although the directions (X, Y, and Z) are mutually orthogonal in the present embodiment, the relationship between configurations is not necessarily limited to being orthogonal.

The X direction is an example of "second direction" and the Y direction is an example of "first direction".

Liquid Ejecting Apparatus

The liquid ejecting apparatus IJP according to the present embodiment is, for example, an ink jet printer performing printing by ejecting ink, which is an example of "liquid", onto a medium S such as paper.

As illustrated in FIG. 1, a liquid ejecting head 1, a carriage 3, an apparatus main body 4, a liquid supply source 110, and so on constitute the liquid ejecting apparatus IJP.

The liquid ejecting head 1 is detachably attached to the liquid supply source 110, is supplied with ink from the liquid supply source 110, and ejects the ink onto the medium S. The liquid ejecting head 1 will be described in detail later.

The liquid supply source (ink cartridge) 110 stores ink to be supplied to the liquid ejecting head 1. A plurality of the liquid supply sources 110 is provided in accordance with the number of nozzle row sets 23 (described later) provided in the liquid ejecting head 1.

In the liquid ejecting apparatus IJP according to the present embodiment, the liquid supply sources 110 for four colors are mounted on the carriage 3. The liquid supply sources 110 are a liquid supply source 110C storing cyan (C) ink, a liquid supply source 110M storing magenta (M) ink, a liquid supply source 110Y storing yellow (Y) ink, and a liquid supply source 110K storing black (K) ink. In other words, any of the four types of ink is stored in the corresponding one of the four liquid supply sources 110.

The liquid supply source 110K is an example of "first liquid supply source" and the liquid supply source 110Y is an example of "second liquid supply source".

The types of the ink is not limited to four in number and the number may be less than four or more than four. The liquid supply sources 110 are not limited to four in number and the number may be less than four or more than four.

The liquid ejecting head 1 is mounted on the carriage 3. The carriage 3 is provided so as to be capable of reciprocating in the axial direction (X direction) of a carriage shaft 5 attached to the apparatus main body 4. Specifically, the carriage 3 on which the liquid ejecting head 1 is mounted reciprocates along the carriage shaft 5 by the drive force of a drive motor 6 being transmitted to the carriage 3 via a timing belt 7 and a plurality of gears (not illustrated).

The apparatus main body 4 is a housing in which the liquid ejecting head 1, the carriage 3, the liquid supply sources 110, and so on are accommodated. The apparatus main body 4 is provided with a transport roller 8 as transport means. The medium S is transported by the transport roller 8. The transport means for transporting the medium S is not limited to the transport roller and may be a belt, a drum, or the like.

Liquid Ejecting Head

Figure 2:
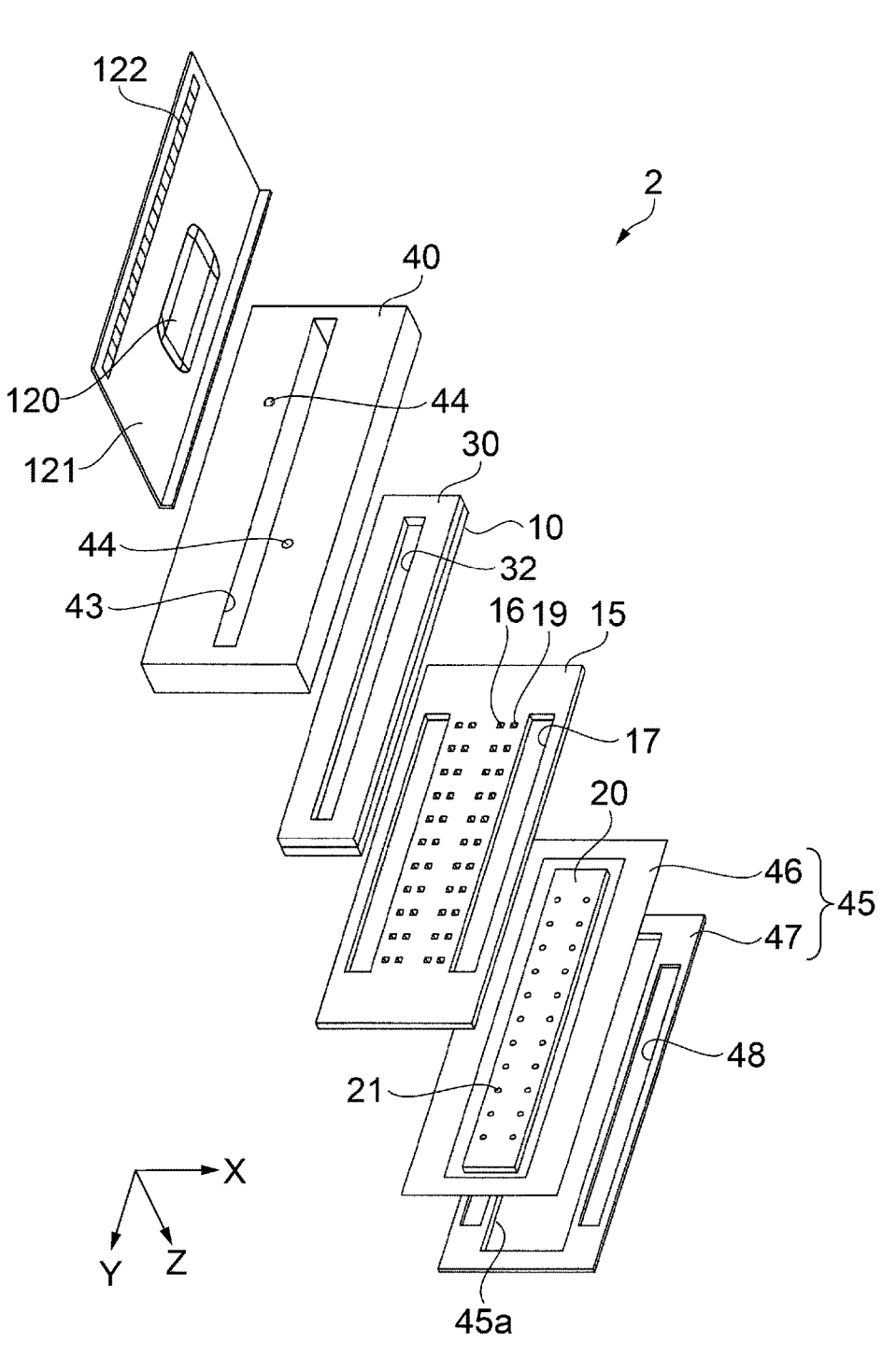
FIG. 2 is an exploded perspective view of a head main body according to the embodiment.
Figure 3:
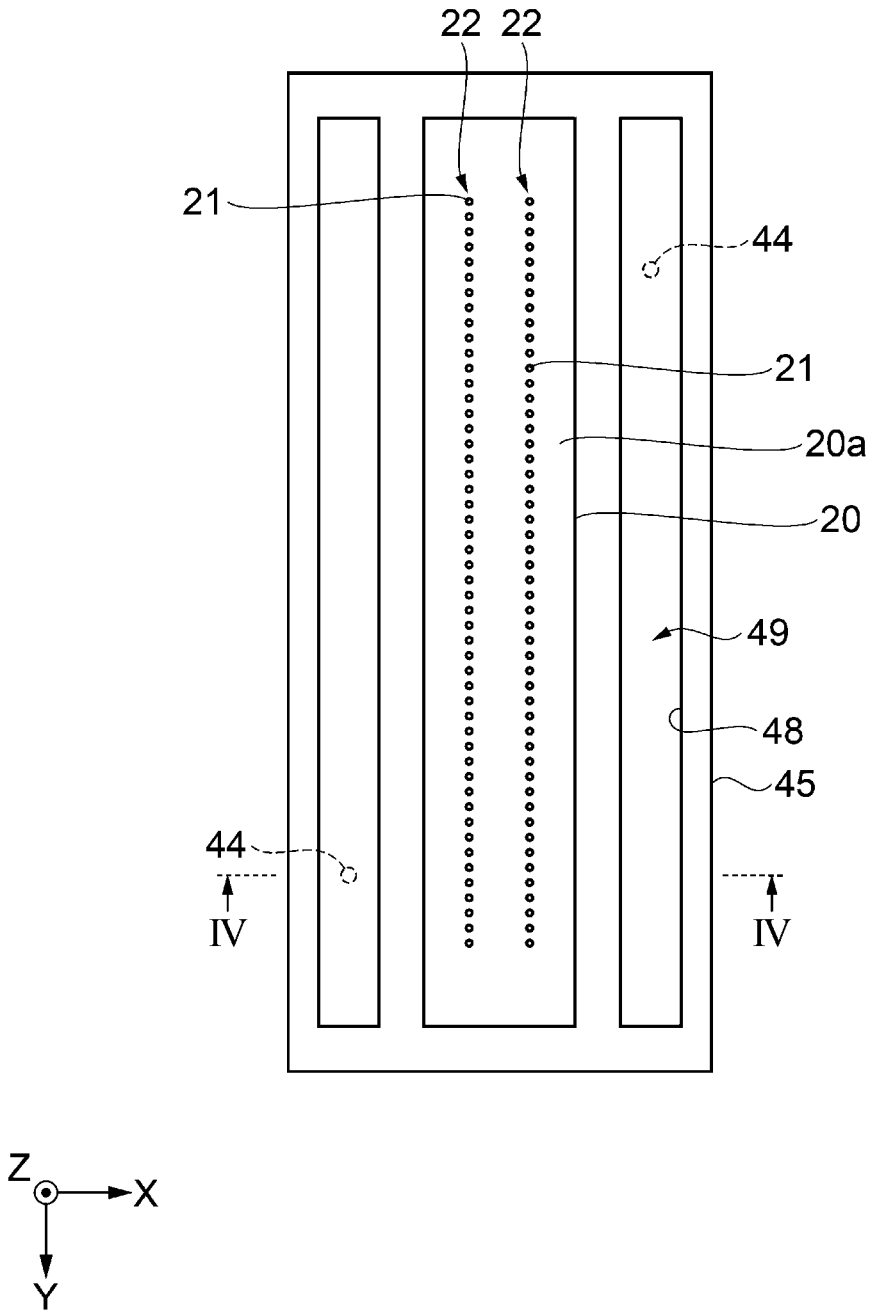
FIG. 3 is a plan view of the head main body according to the embodiment.
Figure 4:
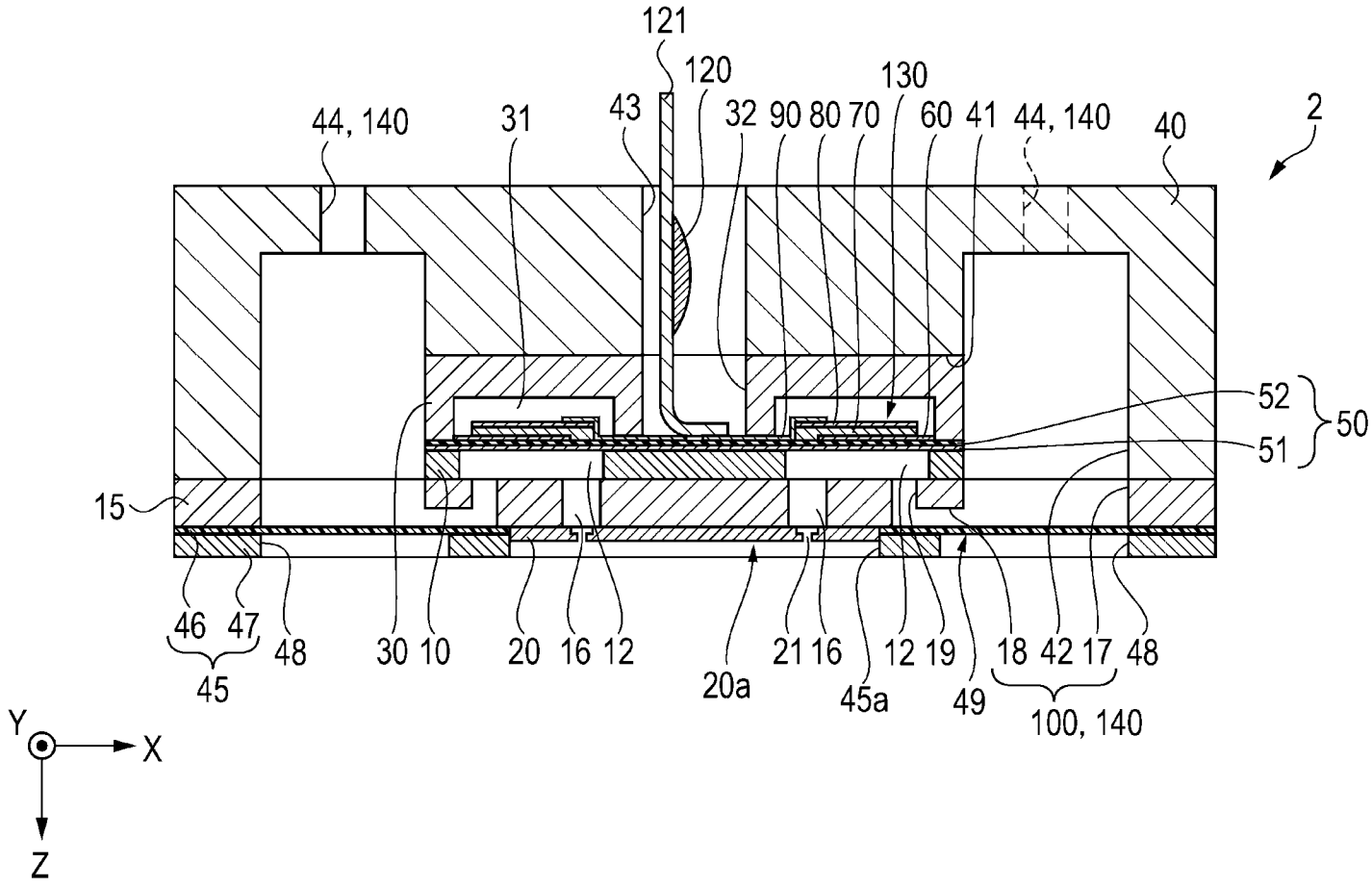
FIG. 4 is a sectional view taken along line IV-IV in FIG. 3.

FIG. 2 is an exploded perspective view of a head main body 2. FIG. 3 is a plan view in which the head main body 2 is viewed from the +Z direction. FIG. 4, which is viewed from the +Y direction, is a sectional view of the head main body 2 taken along line IV-IV in FIG. 3.

The head main body 2, a flow path member 200 (see FIG. 5), a head case 250 (see FIG. 5), a head substrate 300 (see FIG. 5), and so on constitute the liquid ejecting head 1 according to the present embodiment. Next, the head main body 2 provided in the liquid ejecting head 1 according to the present embodiment will be described with reference to FIGS. 2 to 4.

As illustrated in FIGS. 2 to 4, a flow path forming substrate 10, a communication plate 15, a nozzle plate 20, a protective substrate 30, a compliance substrate 45, a case member 40, a wiring substrate 121, and so on constitute the head main body 2.

A metal such as stainless steel, a ceramic material, a glass ceramic material, an oxide, or the like can be used for the flow path forming substrate 10. In the flow path forming substrate 10, pressure chambers 12 partitioned by a plurality of partition walls are arranged in parallel along the Y direction. Such pressure chambers 12 are formed by anisotropic etching being performed from one surface side of the flow path forming substrate 10.

The flow path forming substrate 10 is provided with a plurality of rows (two rows in the present embodiment). In each of the rows, the plurality of pressure chambers 12 is arranged in parallel in the Y direction. The rows of the pressure chambers 12 (two rows in the present embodiment) are disposed side by side in the X direction, which intersects the Y direction. Further, in the present embodiment, ink droplets (droplets) are ejected in the Z direction, which intersects the X direction and the Y direction.

Hereinafter, the pressure chamber 12 communicating with the liquid supply source 110Y will be referred to as a pressure chamber 12Y (see FIG. 9), the pressure chamber 12 communicating with the liquid supply source 110C will be referred to as a pressure chamber 12C (see FIG. 9), the pressure chamber 12 communicating with the liquid supply source 110M will be referred to as a pressure chamber 12M (see FIG. 9), and the pressure chamber 12 communicating with the liquid supply source 110K will be referred to as a pressure chamber 12K (see FIG. 9).

The pressure chamber 12K is an example of "first pressure chamber" and the pressure chamber 12Y is an example of "second pressure chamber".

On one surface side (+Z direction side) of the flow path forming substrate 10, the communication plate 15 and the nozzle plate 20 are sequentially stacked in the Z direction. In other words, the head main body 2 includes the communication plate 15 provided at one surface of the flow path forming substrate 10 and the nozzle plate 20 provided at an opposite surface side of the communication plate 15 from the flow path forming substrate 10.

The communication plate 15 is provided with a nozzle communication path 16, which allows the pressure chamber 12 and a nozzle 21 to communicate with each other. The communication plate 15 is larger in area than the flow path forming substrate 10. The nozzle plate 20 is smaller in area than the flow path forming substrate 10. By the communication plate 15 being provided in this manner, the pressure chamber 12 and the nozzle 21 of the nozzle plate 20 can be separated from each other. Accordingly, the ink in the pressure chamber 12 is unlikely to be affected by thickening attributable to ink moisture evaporation that the ink in the vicinity of the nozzle 21 undergoes. In addition, the nozzle plate 20 simply covers the opening of the nozzle communication path 16 communicating with the pressure chamber 12 and the nozzle 21, and thus the area of the nozzle plate 20 can be relatively small and cost reduction can be achieved.

The communication plate 15 is provided with a second manifold portion 18 and a first manifold portion 17 constituting a part of a common flow path 100.

Hereinafter, the common flow path 100 communicating with the pressure chamber 12Y will be referred to as a common flow path 100Y, the common flow path 100 communicating with the pressure chamber 12C will be referred to as a common flow path 100C, the common flow path 100 communicating with the pressure chamber 12M will be referred to as a common flow path 100M, and the common flow path 100 communicating with the pressure chamber 12K will be referred to as a common flow path 100K.

The common flow path 100K is an example of "first common flow path" and the common flow path 100Y is an example of "second common flow path".

The first manifold portion 17 is provided so as to penetrate the communication plate 15 in the thickness direction (Z direction). The second manifold portion 18 is provided so as to be open to the nozzle plate 20 side (+Z direction side) of the communication plate 15 without penetrating the communication plate 15 in the thickness direction. The second manifold portion 18 functions as an orifice restricting the flow rate of the liquid.

Further, the communication plate 15 is provided with individual flow paths 19. The individual flow path 19 is provided independently for each pressure chamber 12 and communicates with one end portion of the pressure chamber 12 in the X direction. The individual flow path 19 allows the second manifold portion 18 and the pressure chamber 12 to communicate with each other. A metal such as stainless steel, ceramics, or the like can be used as the communication plate 15.

The nozzle plate 20 has the nozzles 21 communicating with the respective pressure chambers 12 via the nozzle communication paths 16. The nozzles 21 form a nozzle row 22 by being arranged in parallel in the Y direction. In the head main body 2, two nozzle rows 22 are formed side by side in the X direction.

Hereinafter, the direction in which the plurality of nozzles 21 is arranged in order to constitute the nozzle row 22 will be referred to as the nozzle row direction. The ink droplet ejecting surface that is one of the both surfaces of the nozzle plate 20, that is, the surface on the side opposite from the pressure chamber 12 will be referred to as a liquid ejecting surface 20*a*. Further, the nozzle 21 communicating with the pressure chamber 12Y will be referred to as a nozzle 21Y, the nozzle 21 communicating with the pressure chamber 12C will be referred to as a nozzle 21C, the nozzle 21 communicating with the pressure chamber 12M will be referred to as a nozzle 21M, and the nozzle 21 communicating with the pressure chamber 12K will be referred to as a nozzle 21K.

A metal such as stainless steel (SUS), organic matter such as polyimide resin, a silicon single crystal substrate, or the like can be used as the nozzle plate 20. By using a silicon single crystal substrate as the nozzle plate 20 and causing the linear expansion coefficients of the nozzle plate 20 and the communication plate 15 to be equal to each other, it is possible to reduce the occurrence of warpage attributable to heating or cooling and the occurrence of, for example, cracking and peeling attributable to heat.

In addition, a supply flow path 140, which supplies ink to the nozzle 21, is given a negative pressure by a pressure adjustment unit (not illustrated) provided in the liquid supply source 110. Accordingly, a meniscus recessed inward with respect to the opening of the nozzle 21 is formed in the nozzle 21 communicating with the supply flow path 140. Usually, the meniscus in the nozzle 21 is maintained in a shape allowing ink ejection by the pressure adjustment unit.

The pressure adjustment unit is, for example, a pressure adjustment valve performing opening/closing operation when the supply flow path 140 has reached a predetermined pressure. The pressure adjustment unit may be, for example, provided on the ink supply flow path 140 without being provided in the liquid supply source 110.

A diaphragm 50 is formed on the surface side of the flow path forming substrate 10 that is opposite from the communication plate 15. In the present embodiment, an elastic film 51 provided on the flow path forming substrate 10 side and an insulator film 52 provided above the elastic film 51 constitute the diaphragm 50. A liquid flow path such as the pressure chamber 12 is formed by anisotropic etching being performed on the flow path forming substrate 10 from one surface side (surface side where the nozzle plate 20 is joined). The other surface of the liquid flow path such as the pressure chamber 12 is defined by the elastic film 51.

A piezoelectric actuator 130 as pressure generating means is provided on the diaphragm 50 of the flow path forming substrate 10. The piezoelectric actuator 130 has a first electrode 60, a piezoelectric layer 70, and a second electrode 80. Here, the piezoelectric actuator 130 refers to a part including the first electrode 60, the piezoelectric layer 70, and the second electrode 80. In a general configuration, one of the electrodes of the piezoelectric actuator 130 is a common electrode and the other electrode of the piezoelectric actuator 130 is patterned for each pressure chamber 12. In the present embodiment, the first electrode 60 is used as a common electrode by being continuously provided across a plurality of the piezoelectric actuators 130 and the second electrode 80 is used as an individual electrode by being provided independently for each piezoelectric actuator 130. It is a matter of course that this may be reversed for the convenience of a drive circuit or wiring.

Although the elastic film 51 and the insulator film 52 constitute the diaphragm 50 in the example described above, it is a matter of course that the present disclosure is not limited thereto. For example, the diaphragm 50 may be constituted by one of the elastic film 51 and the insulator film 52. In addition, the first electrode 60 may function as a diaphragm with the diaphragm 50 that is constituted by the elastic film 51 and the insulator film 52 omitted. The piezoelectric actuator 130 itself may substantially serve as a diaphragm.

Further, one end portion of a lead electrode 90 made of gold (Au) or the like is coupled to the second electrode 80, which is the individual electrode of the piezoelectric actuator 130. The lead electrode 90 is provided so as to extend from the vicinity of the end portion that is on the side opposite from the individual flow path 19 and extend up to the upper part of the diaphragm 50.

In addition, the wiring substrate 121 provided with a drive circuit 120 for driving the piezoelectric actuator 130 is coupled to the other end portion of the lead electrode 90. A sheet-shaped flexible substrate such as a COF substrate can be used as the wiring substrate 121.

A second terminal 122 electrically coupled to a first terminal 311 of the head substrate 300 (described later) is formed at one surface of the wiring substrate 121. The wiring substrate 121 may not be provided with the drive circuit 120. In other words, the wiring substrate 121 is not limited to the COF substrate and may be FFC, FPC, and so on.

The protective substrate 30, which has substantially the same size as the flow path forming substrate 10, is joined to the surface of the flow path forming substrate 10 that is on the piezoelectric actuator 130 side. The protective substrate 30 has a holding portion 31, which is a space for protecting the piezoelectric actuator 130. The holding portion 31 has a recessed shape open to the flow path forming substrate 10 side without penetrating the protective substrate 30 in the Z direction, which is the thickness direction. In addition, the holding portion 31 is independently provided for each row constituted by the piezoelectric actuators 130 arranged in parallel in the Y direction. In other words, the two holding portions 31 are arranged in parallel in the X direction so as to accommodate the rows of the piezoelectric actuators 130 arranged in parallel in the Y direction. The holding portion 31 may have a space to the extent that the motion of the piezoelectric actuator 130 is not hindered. The space may be sealed or unsealed.

The protective substrate 30 has a through hole 32 penetrating the protective substrate 30 in the Z direction, which is the thickness direction. The through hole 32 is provided across the Y direction, which is the direction in which the plurality of piezoelectric actuators 130 is arranged in parallel, between the two holding portions 31 arranged in parallel in the X direction. In other words, the through hole 32 is an opening having a long side in the direction in which the plurality of piezoelectric actuators 130 is arranged in parallel. The other end portion of the lead electrode 90 is provided so as to extend in the X direction so as to be exposed in the through hole 32 and the lead electrode 90 and the wiring substrate 121 are electrically coupled in the through hole 32. Methods for joining the flow path forming substrate 10 and the protective substrate 30 are not particularly limited. For example, in the present embodiment, the flow path forming substrate 10 and the protective substrate 30 are joined by using an adhesive (not illustrated).

The case member 40 has substantially the same shape as the communication plate 15 in plan view as seen from the Z direction and is joined to the communication plate 15 as well as to the protective substrate 30. Specifically, the case member 40 has a recess 41 having a depth at which the flow path forming substrate 10 and the protective substrate 30 are accommodated on the protective substrate 30 side. The opening area of the recess 41 is wider than the surface of the protective substrate 30 joined to the flow path forming substrate 10. The opening surface of the recess 41 that is on the nozzle plate 20 side is sealed by the communication plate 15 in a state where the recess 41 accommodates the flow path forming substrate 10 and so on. As a result, a third manifold portion 42 is defined by the case member 40 in the outer peripheral portion of the flow path forming substrate 10.

The common flow path 100 is constituted by the first manifold portion 17 and the second manifold portion 18 which are provided in the communication plate 15 and the third manifold portion 42 defined by the case member 40. In other words, the common flow path 100 includes the first manifold portion 17, the second manifold portion 18, and the third manifold portion 42. In addition, the common flow path 100 is disposed on both outer sides of the two rows of pressure chambers 12 in the X direction and the two common flow paths 100 provided on both outer sides of the two rows of pressure chambers 12 are provided independently of each other so as not to communicate with each other in the head main body 2.

The case member 40 has an inlet port 44 communicating with the common flow path 100. In other words, the inlet port 44 is an opening portion to be used as an inlet through which the ink supplied to the head main body 2 is introduced into the common flow path 100. The common flow path 100 and the inlet port 44 are flow paths constituting a part of the supply flow path 140 provided in the liquid ejecting head 1.

In addition, the case member 40 is provided with a coupling port 43 communicating with the through hole 32 of the protective substrate 30. The wiring substrate 121 is inserted through the coupling port 43. The other end portion of the wiring substrate 121 extends along the direction in which the through hole 32 and the coupling port 43 penetrate, that is, the direction (−Z direction) opposite from the direction in which an ink droplet is ejected. Resin, metal, or the like can be used as the material of the case member 40.

Hereinafter, the inlet port 44 communicating with the common flow path 100Y will be referred to as an inlet port 44Y, the inlet port 44 communicating with the common flow path 100C will be referred to as an inlet port 44C, the inlet port 44 communicating with the common flow path 100M will be referred to as an inlet port 44M, and the inlet port 44 communicating with the common flow path 100K will be referred to as an inlet port 44K.

The compliance substrate 45 is provided on the surface of the communication plate 15 where the first manifold portion 17 and the second manifold portion 18 are open. The compliance substrate 45 has substantially the same size as the communication plate 15 in plan view as seen from the Z direction and is provided with a first opening portion 45*a*, which exposes the nozzle plate 20. In a state where the compliance substrate 45 exposes the nozzle plate 20 through the first opening portion 45*a*, the openings of the first manifold portion 17 and the second manifold portion 18 on the liquid ejecting surface 20*a* side are sealed. In other words, the compliance substrate 45 defines a part of the common flow path 100.

The compliance substrate 45 includes a flexible sealing film 46 and a fixed substrate 47. The sealing film 46 is formed of a film-shaped flexible thin film (such as a thin film having a thickness of 20 μm or less and formed of polyphenylene sulfide (PPS) or the like). The sealing film 46 may be formed by a metal such as SUS or a hard material such as silicon being reduced in thickness to the extent of having flexibility.

The fixed substrate 47 is formed of a hard material such as a metal such as stainless steel (SUS). The region of the fixed substrate 47 that faces the common flow path 100 is a second opening portion 48 completely removed in the thickness direction. One surface of the common flow path 100 is in a state of being sealed only by the flexible sealing film 46 in the second opening portion 48. The part of the common flow path 100 that is sealed only by the sealing film 46 is a compliance portion 49 and can be flexurally deformed.

The compliance portion in the present application is a flexurally deformable part in the supply flow path 140, which supplies ink from the liquid supply source 110 to the pressure chamber 12. When the pressure of the ink fluctuates in the supply flow path 140, the compliance portion constituting a part of the supply flow path 140 is flexurally deformed. The flexural deformation of the compliance portion results in a change in the volume of the supply flow path 140 and the ink pressure fluctuation is alleviated in the supply flow path 140.

The compliance portion 49 provided in the common flow path 100 forming a part of the supply flow path 140 is flexurally deformed due to, for example, the ink pressure fluctuation in the supply flow path 140 that occurs during ink ejection from the nozzle 21 or the ink pressure fluctuation in the supply flow path 140 that occurs during a movement of the carriage 3, alleviates the pressure fluctuation, and causes the ink to be ejected with stability from the nozzle 21.

When the compliance portion is flexurally deformable to a significant extent and the compliance capacity of the supply flow path 140 increases due to the flexural deformation of the compliance portion, the compliance capacity of the supply flow path 140 significantly increases. The compliance capacity of the supply flow path 140 decreases when it is difficult for the compliance portion to be flexurally deformed to a significant extent and it is difficult for the supply flow path 140 to be significantly changed in volume as a result of the flexural deformation of the compliance portion.

When the compliance capacity of the supply flow path 140 is large, the compliance portion is capable of alleviating large ink pressure fluctuations in the supply flow path 140. When the compliance capacity of the supply flow path 140 is small, it is difficult for the compliance portion to alleviate large ink pressure fluctuations in the supply flow path 140 although the compliance portion is capable of alleviating small ink pressure fluctuations in the supply flow path 140.

In this manner, the compliance capacity in the present application represents the degree of pressure fluctuations that can be alleviated by the compliance portion.

For example, when the sealing film 46 is the same, the change in the volume of the common flow path 100 that results from the flexural deformation of the sealing film 46 becomes significant when the second opening portion 48 is enlarged and the area of the compliance portion 49 increases. As a result, large pressure fluctuations can be alleviated.

For example, when the second opening portion 48 is of the same size and the area of the compliance portion 49 is the same, the change in the volume of the common flow path 100 that results from a significant flexural deformation of the sealing film 46 becomes significant when the sealing film 46 becomes thin and the sealing film 46 becomes likely to be flexurally deformed to a significant extent. As a result, large pressure fluctuations can be alleviated.

As described above, the compliance capacity depends on the area of the region where the flexible member can be deformed and the amount of deformation of the flexible member, the compliance capacity increases when the area of the region where the flexible member can be deformed increases, the compliance capacity increases when the flexible member becomes likely to be deformed and the amount of displacement of the flexible member increases, and large pressure fluctuations can be alleviated in those respective cases.

In the present embodiment, one compliance portion 49 is provided in one common flow path 100 and the number of the common flow paths 100 is two. Accordingly, two compliance portions 49 are provided on both sides in the X direction across the nozzle plate 20.

Hereinafter, the compliance portion 49 corresponding to the common flow path 100Y will be referred to as a compliance portion 49Y, the compliance portion 49 corresponding to the common flow path 100C will be referred to as a compliance portion 49C, the compliance portion 49 corresponding to the common flow path 100M will be referred to as a compliance portion 49M, and the compliance portion 49 corresponding to the common flow path 100K will be referred to as a compliance portion 49K.

The compliance portion 49K is an example of "first compliance portion" and the compliance portion 49Y is an example of "second compliance portion".

In the head main body 2 configured as described above, the ink is taken in via the inlet port 44 and the inner portion of the flow path is filled with the ink from the common flow path 100 to the nozzle 21 when the ink is ejected. Subsequently, the piezoelectric actuator 130 is expanded and contracted by voltage being applied to each piezoelectric actuator 130 corresponding to the pressure chamber 12 in accordance with a signal from the drive circuit 120. As a result, the diaphragm 50 joined to the piezoelectric actuator 130 is flexurally deformed, the internal pressure of the pressure chamber 12 increases, and the ink is ejected from the nozzle 21 as ink droplets.

Figure 5:
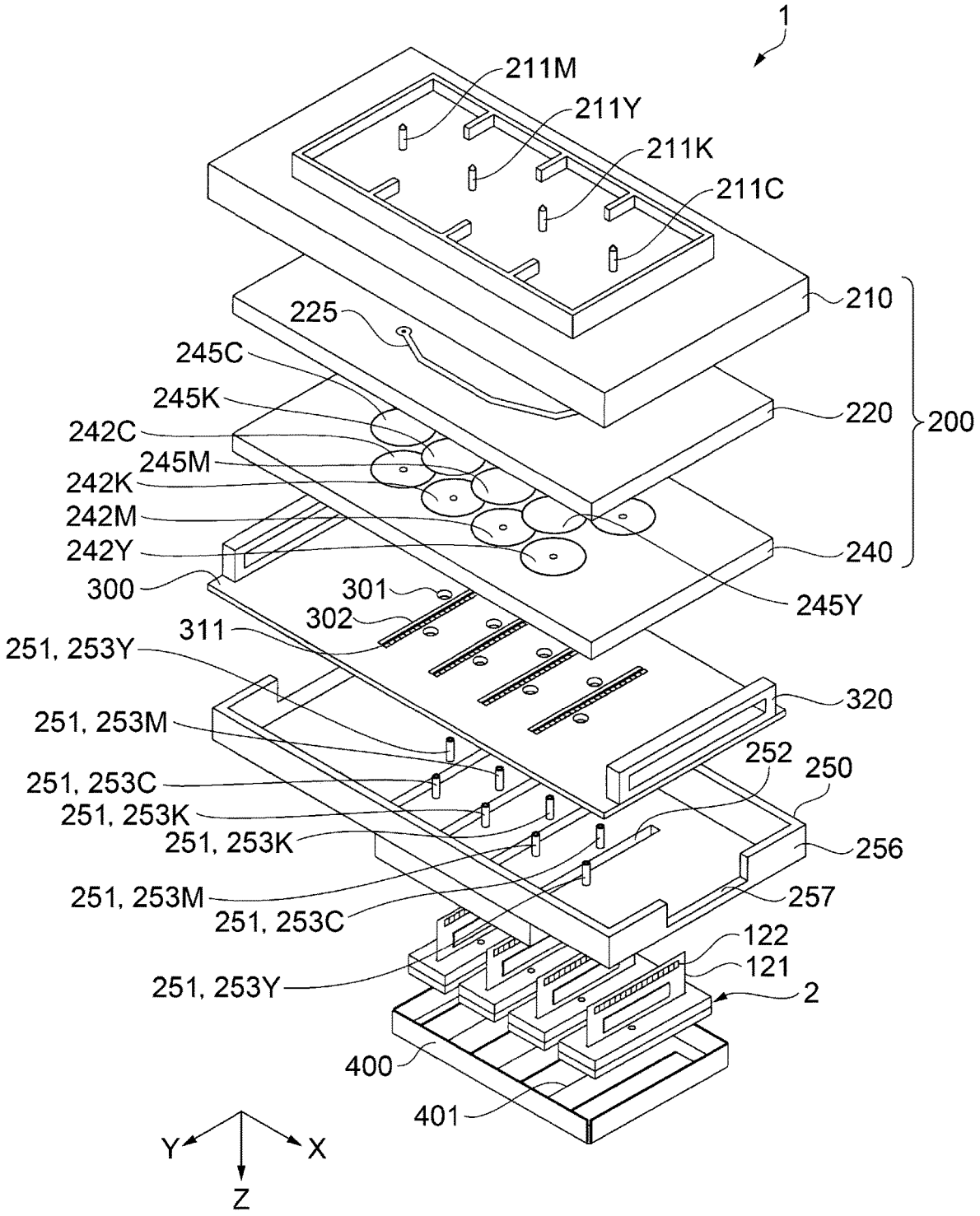
FIG. 5 is an exploded perspective view of a liquid ejecting head according to the embodiment.
Figure 6:
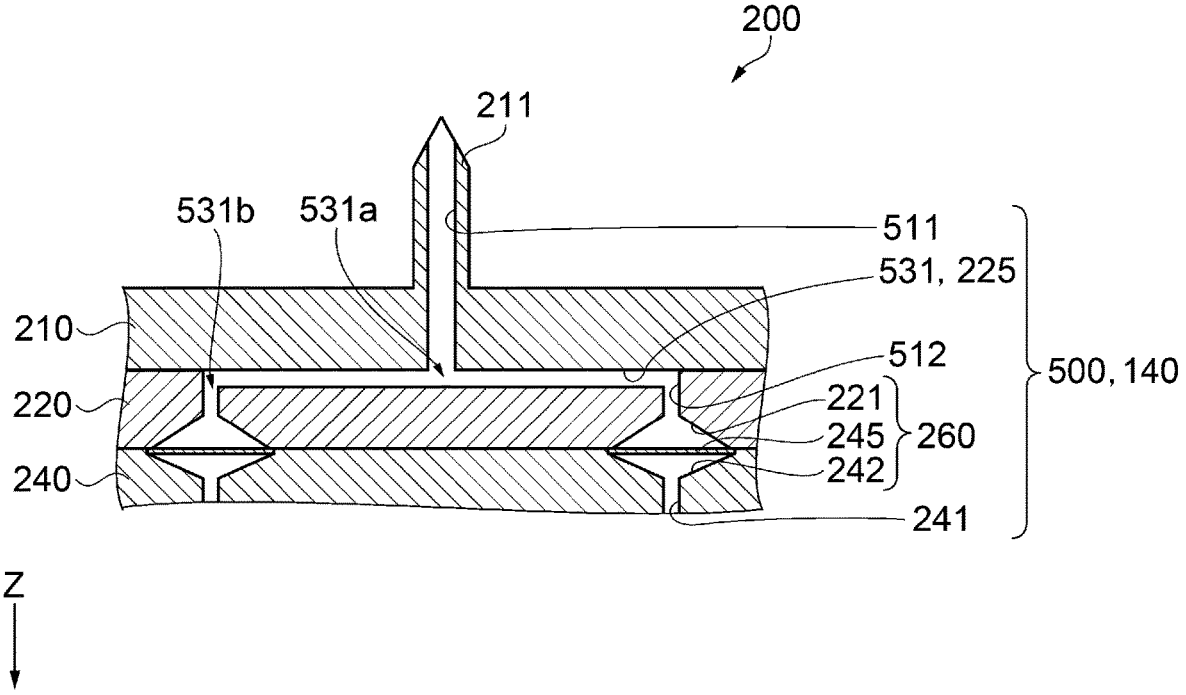
FIG. 6 is a sectional view illustrating a main portion of a flow path member according to the embodiment.
Figure 7:
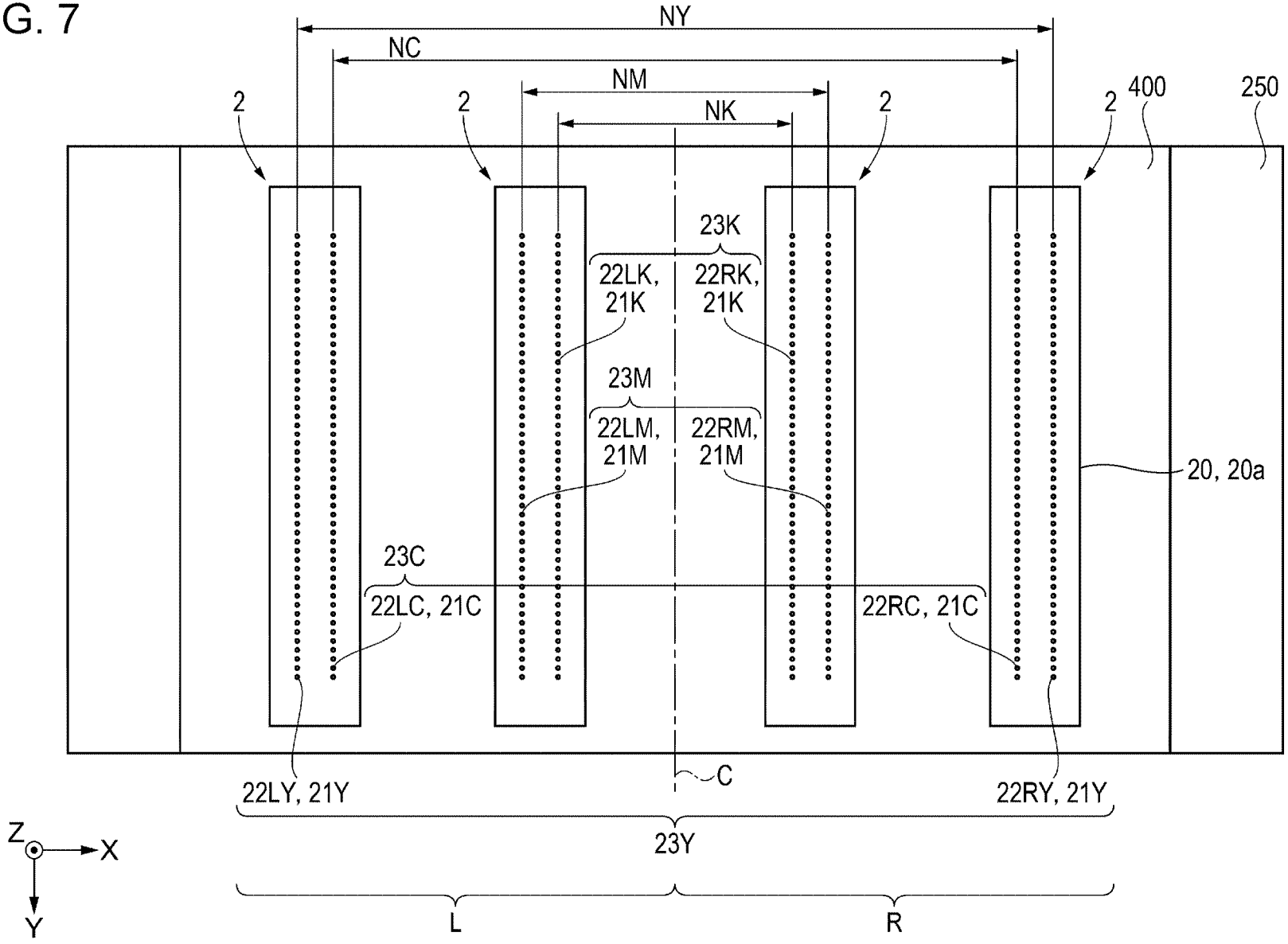
FIG. 7 is a bottom view of the liquid ejecting head according to the embodiment.
Figure 8:
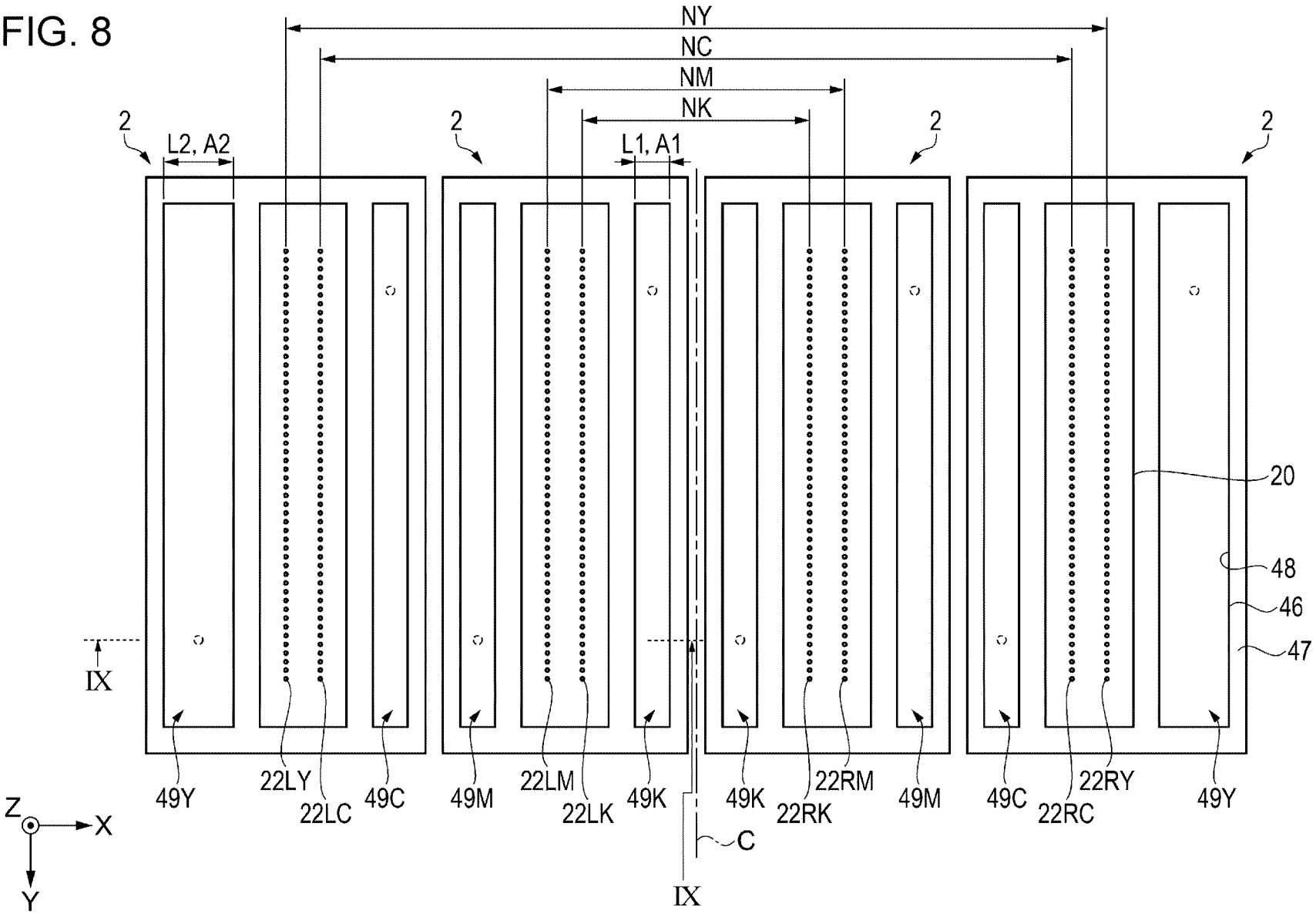
FIG. 8 is a bottom view of a plurality of head main bodies according to the embodiment.

FIG. 5 is an exploded perspective view of the liquid ejecting head 1. FIG. 6 is a sectional view of the main portion of the flow path member 200. FIGS. 7 and 8 are bottom views in which the liquid ejecting head 1 is viewed from the +Z direction.

The flow path member 200 includes four liquid flow paths 500 corresponding to four colors of ink. In FIG. 6, one of the four liquid flow paths 500 is schematically illustrated. The four liquid flow paths 500 corresponding to the four colors of ink have the same configuration.

In FIG. 8, the state of disposition of the head main body 2 in the liquid ejecting head 1 is illustrated with the illustration of the head case 250 and a cover head 400 omitted from the state illustrated in FIG. 7.

Next, the liquid ejecting head 1 having the head main body 2 will be described with reference to FIGS. 5 to 8.

As illustrated in FIG. 5, the liquid ejecting head 1 includes four head main bodies 2, the head case 250 holding the head main body 2, the head substrate 300 supported above the head case 250, and the flow path member 200.

As illustrated in FIG. 6, the flow path member 200 is a member forming the liquid flow path 500, through which ink is supplied from the liquid supply source 110 to the head main body 2. The liquid flow path 500 is provided with a filter 245. Specifically, the flow path member 200 includes a first flow path member 210, a second flow path member 220, and a filter holding member 240. The first flow path member 210, the second flow path member 220, and the filter holding member 240 are integrally formed by means of, for example, an adhesive or welding.

Means for stacking and fixing these members is not particularly limited and the fixing may be performed by means of a screw, a clamp, or the like. The liquid flow path 500 constitutes a part of the supply flow path 140.

The first flow path member 210 is a member constituting a first vertical flow path 511, a branch flow path 531, and a second vertical flow path 512, as a part of the liquid flow path 500. Specifically, the first flow path member 210 has a coupling portion 211 coupled to the liquid supply source 110 on the surface side (−Z direction side) opposite from the second flow path member 220. In the present embodiment, the coupling portion 211 protrudes in a needle shape. The first flow path member 210 is provided with the first vertical flow path 511 open to the top surface of the coupling portion 211 and penetrating the first flow path member 210 in the thickness direction (Z direction).

Hereinafter, the coupling portion 211 coupled to the liquid supply source 110Y will be referred to as a coupling portion 211Y, the coupling portion 211 coupled to the liquid supply source 110C will be referred to as a coupling portion 211C, the coupling portion 211 coupled to the liquid supply source 110M will be referred to as a coupling portion 211M, and the coupling portion 211 coupled to the liquid supply source 110K will be referred to as a coupling portion 211K.

The liquid supply source 110 such as an ink cartridge may be directly coupled to the coupling portion 211. Alternatively, another liquid supply source such as an ink tank may be coupled to the coupling portion 211 via, for example, a supply pipe such as a tube.

The second flow path member 220 is a member constituting the branch flow path 531, the second vertical flow path 512, and a first filter chamber 221, as a part of the liquid flow path 500. The second vertical flow path 512 is formed by the first flow path member 210 and the second flow path member 220, and thus the first flow path member 210 and the second flow path member 220 are members constituting the second vertical flow path 512.

Specifically, a groove 225 is formed in the surface of the second flow path member 220 that is on the first flow path member 210 side (−Z direction side). The branch flow path 531, which is a horizontal flow path, is formed by the groove 225 sealed by the first flow path member 210 by the second flow path member 220 being joined to the first flow path member 210.

The surface of the second flow path member 220 that is on the filter holding member 240 side (+Z direction side) is provided with the first filter chamber 221. The first filter chamber 221 is a recess formed so as to increase in diameter toward the filter holding member 240 side. The second vertical flow path 512 interconnecting the first filter chamber 221 and the branch flow path 531 is formed in the second flow path member 220.

In the branch flow path 531, a branch portion 531*a* other than both ends communicates with the first vertical flow path 511 and both end portions 531*b* communicate with the second vertical flow path 512. In other words, the branch flow path 531 bifurcates in the branch portion 531*a* and the respective branches reach the filter 245 via the end portions 531*b*. In other words, the liquid flow path 500 bifurcates on the branch flow path 531, which is upstream of the filter 245.

The filter holding member 240 constitutes a filter chamber 260, which is a part of the liquid flow path 500, with the second flow path member 220. Specifically, a second filter chamber 242 is formed at the surface of the filter holding member 240 that is on the second flow path member 220 side (−Z direction side). The second filter chamber 242 is a recess formed so as to increase in diameter toward the second flow path member 220 side. The filter holding member 240 is provided with a third vertical flow path 241, which communicates with the second filter chamber 242 and penetrates the filter holding member 240 in the thickness direction (Z direction).

The second filter chamber 242 is provided so as to face the first filter chamber 221. The first filter chamber 221 and the second filter chamber 242 constitute the filter chamber 260, which is formed by the second flow path member 220 and the filter 245 being joined. The filter chamber 260 is a space constituting a part of the liquid flow path 500. The filter 245 is provided so as to cross the space. The filter 245 of the present embodiment has a circular shape when viewed from the Z direction. The filter 245 may have a rectangular shape when viewed from the Z direction.

The filter 245 removes bubbles and foreign substances from ink. The ink supplied from the branch flow path 531 flows into the third vertical flow path 241 after the foreign substances and bubbles in the ink being captured by the filter 245.

The flow path member 200 of the present embodiment is provided with the four liquid flow paths 500 corresponding to the four colors of ink. The four liquid flow paths 500 are supplied with the four colors of ink, respectively. In other words, the four liquid flow paths 500 corresponding to the four colors of ink bifurcate on the branch flow path 531 and communicate with the third vertical flow path 241, and thus the flow path member 200 is provided with eight third vertical flow paths 241.

The four colors of ink are yellow (Y) ink, cyan (C) ink, magenta (M) ink, and black (K) ink. The black (K) ink is an example of "first liquid" and the yellow (Y) ink is an example of "second liquid". The colors of the black (K) ink as an example of "first liquid" and the yellow (Y) ink as an example of "second liquid" are different from each other.

Further, the flow path through which the yellow (Y) ink is supplied will be referred to as a supply flow path 140Y, the flow path through which the cyan (C) ink is supplied will be referred to as a supply flow path 140C, the flow path through which the magenta (M) ink is supplied will be referred to as a supply flow path 140M, and the flow path through which the black (K) ink is supplied will be referred to as a supply flow path 140K. The supply flow path 140K is an example of "first supply flow path" and the supply flow path 140Y is an example of "second supply flow path".

Further, the liquid flow path 500 constitutes a part of the supply flow path 140, and thus the supply flow path 140Y has a liquid flow path 500Y through which the yellow (Y) ink flows, the supply flow path 140C has a liquid flow path 500C through which the cyan (C) ink flows, the supply flow path 140M has a liquid flow path 500M through which the magenta (M) ink flows, and the supply flow path 140K has a liquid flow path 500K through which the black (K) ink flows. The liquid flow path 500K through which the black (K) ink flows is an example of "first liquid flow path" and the liquid flow path 500Y through which the yellow (Y) ink flows is an example of "second liquid flow path".

Further, the filter 245 provided in the supply flow path 140Y will be referred to as a filter 245Y, the filter 245 provided in the supply flow path 140C will be referred to as a filter 245C, the filter 245 provided in the supply flow path 140M will be referred to as a filter 245M, and the filter 245 provided in the supply flow path 140K will be referred to as a filter 245K. The filter 245K is an example of "first filter" and the filter 245Y is an example of "second filter".

The head case 250 is a member holding the head main body 2. The surface of the head case 250 that is on the side (+Z direction side) opposite from the flow path member 200 is provided with a recess-shaped accommodating portion (not illustrated). The accommodating portion has a size at which the four head main bodies 2 disposed such that the nozzle rows 22 are arranged in the X direction can be accommodated.

The head case 250 has a plurality of projection portions 251 protruding in the −Z direction from the surface of the head case 250 that is on the flow path member 200 side (−Z direction side). Eight projection portions 251 are provided in the present embodiment. The projection portions 251 are disposed so as to respectively face the eight branching third vertical flow paths 241 of the liquid flow path 500 provided in the flow path member 200.

Each projection portion 251 is provided with a communication flow path 253 penetrating the head case 250 in the Z direction. The communication flow path 253 is open to the top surface (surface facing the flow path member 200) of each projection portion 251. The projection portion 251 side of each communication flow path 253 communicates with the third vertical flow path 241. In addition, the +Z direction side of each communication flow path 253 communicates with the inlet port 44 of the case member 40 of the head main body 2.

Hereinafter, the communication flow path 253 communicating with the inlet port 44Y will be referred to as a communication flow path 253Y, the communication flow path 253 communicating with the inlet port 44C will be referred to as a communication flow path 253C, the communication flow path 253 communicating with the inlet port 44M will be referred to as a communication flow path 253M, and the communication flow path 253 communicating with the inlet port 44K will be referred to as a communication flow path 253K.

The head case 250 has a plurality of first insertion holes 252 through which the wiring substrate 121 of the head main body 2 is inserted. Specifically, each first insertion hole 252 is formed so as to penetrate the head case 250 in the Z direction and communicate with a second insertion hole 302 of the head substrate 300. In the present embodiment, four first insertion holes 252 are provided so as to correspond to the respective wiring substrates 121 provided in the four head main bodies 2.

The head case 250 is provided with a connector coupling port 257 where a wall portion 256 protruding to the flow path member 200 side (−Z direction side) is notched in part.

The head substrate 300 is supported on the surface of the head case 250 that is on the flow path member 200 side (−Z direction side). The head substrate 300 is a member to which the wiring substrate 121 is coupled. An electrical component such as a circuit and a resistor which control, for example, the ejecting operation of the liquid ejecting head 1 via the wiring substrate 121 is mounted on the head substrate 300.

The first terminal 311 to which the second terminal 122 of the wiring substrate 121 is electrically coupled is formed at the surface of the head substrate 300 that is on the flow path member 200 side. In addition, the head substrate 300 has a plurality of the second insertion holes 302 through which the wiring substrate 121 electrically coupled to the head main body 2 is inserted. Specifically, each second insertion hole 302 is formed so as to penetrate the head substrate 300 in the Z direction and communicate with the first insertion hole 252 of the head case 250. In the present embodiment, four second insertion holes 302 are provided so as to correspond to the respective wiring substrates 121 of the four head main bodies 2.

The head substrate 300 is provided with a through hole 301 penetrating the head substrate 300 in the Z direction. The projection portion 251 of the head case 250 is inserted through the through hole 301. In the present embodiment, a total of eight through holes 301 are provided so as to face the projection portion 251.

The head substrate 300 is provided with connectors 320 at both end sides in the X direction. The connector 320 is exposed to the outside from the connector coupling port 257 provided in the head case 250. The connector 320 is coupled to, for example, a circuit provided on the head substrate 300. External wiring (not illustrated) is coupled to the connector 320. A control signal, electric power, and the like are supplied to, for example, the circuit of the head substrate 300 via the external wiring.

The shape of each through hole 301 formed in the head substrate 300 is not limited to the aspect described above. For example, the head substrate 300 may have an insertion hole or a notch such that the insertion hole or the notch does not act as a hindrance when the projection portion 251 is coupled to the third vertical flow path 241.

The wiring substrate 121 coupled to the head main body 2 is inserted into the coupling port 43 of the head main body 2, the first insertion hole 252 of the head case 250, and the second insertion hole 302 of the head substrate 300 and the wiring substrate 121 is bent to the first terminal 311 side of the head substrate 300. The first terminal 311 of the head substrate 300 is electrically coupled to the second terminal 122 provided on the wiring substrate 121.

The liquid flow path 500 of the flow path member 200 communicates with the inlet port 44 of the head main body 2 via the communication flow path 253 of the head case 250.

The cover head 400 is a member to which the head main body 2 is fixed. The cover head 400 is fixed to the head case 250. The cover head 400 is provided with an opening portion 401 exposing the nozzle 21. In the present embodiment, the opening portion 401 has a size allowing the nozzle plate 20 to be exposed, that is, has substantially the same opening as the first opening portion 45*a* of the compliance substrate 45.

The cover head 400 is joined to the surface side (+Z direction side) of the compliance substrate 45 that is opposite from the communication plate 15 and seals the space of the compliance portion 49 that is on the side opposite from the common flow path 100. By covering the compliance portion 49 with the cover head 400 in this manner, it is possible to reduce damage even in the event of contact between the compliance portion 49 and the medium S such as paper. Although not particularly illustrated, the space between the cover head 400 and the compliance portion 49 is open to the atmosphere. In addition, the cover head 400 may be independently provided for each head main body 2.

As described above, the liquid ejecting head 1 is configured by the head case 250 that holds the head main body 2, the head substrate 300, and the flow path member 200 being stacked. In the liquid ejecting head 1 configured as described above, the ink supplied from the coupling portion 211 is supplied to the head main body 2 via the liquid flow path 500 during ink ejection. Then, a control signal from the outside is transmitted to the head substrate 300 and the ink is ejected by the head main body 2 in accordance with the control signal.

The supply flow path 140 is a flow path constituted by the liquid flow path 500, the communication flow path 253, the inlet port 44, and the common flow path 100. In other words, the supply flow path 140 is a flow path through which ink flows from the coupling portion 211 of the flow path member 200 to the common flow path 100 of the head main body 2.

Here, the disposition of the plurality of nozzle rows 22 of the liquid ejecting head 1 will be described in detail.

As illustrated in FIGS. 7 and 8, the head main body 2 has two nozzle rows 22, and the four head main bodies 2 are fixed to the head case 250 and the cover head 400 such that the nozzle rows 22 extending in the Y direction are arranged in parallel in the X direction.

Four colors of ink are used in the present embodiment. A pair of the nozzle rows 22 ejecting ink of the same color among the four colors of ink constitutes the nozzle row set 23. In the nozzle row set 23, the nozzle rows 22 as the pair are disposed so as to be symmetrical about a reference line C, which extends in the Y direction and is indicated by a one-dot chain line in FIG. 7.

Hereinafter, the nozzle row set 23 ejecting the yellow (Y) ink will be referred to as a nozzle row set 23Y, the nozzle row set 23 ejecting the cyan (C) ink will be referred to as a nozzle row set 23C, the nozzle row set 23 ejecting the magenta (M) ink will be referred to as a nozzle row set 23M, and the nozzle row set 23 ejecting the black (K) ink will be referred to as a nozzle row set 23K.

The nozzle row set 23K is an example of "first nozzle row set" and the nozzle row set 23Y is an example of "second nozzle row set".

Further, the four nozzle rows 22 that are disposed on the +X direction side with respect to the reference line C will be referred to as a nozzle group R, and the four nozzle rows 22 that are disposed on the −X direction side with respect to the reference line C will be referred to as a nozzle group L.

In the present embodiment, a nozzle row 22RK ejecting the black (K) ink, a nozzle row 22RM ejecting the magenta (M) ink, a nozzle row 22RC ejecting the cyan (C) ink, and a nozzle row 22RY ejecting the yellow (Y) ink are arranged from the −X direction toward the +X direction as the nozzle rows 22 that constitute the nozzle group R. A nozzle row 22LY ejecting the yellow (Y) ink, a nozzle row 22LC ejecting the cyan (C) ink, a nozzle row 22LM ejecting the magenta (M) ink, and a nozzle row 22LK ejecting the black (K) ink are arranged from the −X direction toward the +X direction as the nozzle rows 22 that constitute the nozzle group L.

In this manner, order of arrangement of types of ink ejected from the nozzle rows 22 in the nozzle group R disposed to one side of the reference line C and order of arrangement of types of ink ejected from the nozzle rows 22 in the nozzle group L disposed to the other side of the reference line C are opposite to each other.

Hereinafter, such an arrangement of the nozzle rows 22 will be referred to as symmetrical arrangement.

The distance in the X-direction between the nozzle rows 22 as a pair constituting the nozzle row set 23, that is, the interval between the nozzle rows 22 constituting the nozzle row set 23 will be referred to as an inter-nozzle row distance N. As illustrated in FIGS. 7 and 8, as for the inter-nozzle row distance N, an inter-nozzle row distance NY of the nozzle row set 23Y is the longest, an inter-nozzle row distance NC of the nozzle row set 23C is the second-longest, an inter-nozzle row distance NM of the nozzle row set 23M is the third-longest, and an inter-nozzle row distance NK of the nozzle row set 23K is the shortest.

As for the aspect in which the nozzle rows 22 ejecting ink of the same color are disposed so as to be symmetrical about the reference line C, the arrangement of types of ink ejected from the nozzle rows 22 may simply be symmetrical about the reference line C as described above. Accordingly, there is no need to equidistantly dispose the nozzle rows 22 ejecting ink of the same color about the reference line C.

In the present embodiment, one of the pair of nozzle rows 22 forming the nozzle row set 23 is constituted by 180 nozzles and has a nozzle interval of "180 dpi". One of the nozzle rows 22 that eject ink of the same color is shifted at an interval of "360 dpi", which is half the nozzle pitch, in the Y direction (nozzle row direction) as compared with the other nozzle row 22. Accordingly, 360 nozzles eject ink of one color, and the nozzles 21 ejecting ink of one color are arranged in the Y direction and at an interval of 360 dpi in the liquid ejecting head 1.

Further, although one head main body 2 is provided with two nozzle rows 22 in the present embodiment, the relationship between the head main body 2 and the nozzle row 22 is not limited to such an aspect. All the nozzle rows 22 may be provided in one head main body 2 or one nozzle row 22 may be provided in one head main body 2.

Figure 9:
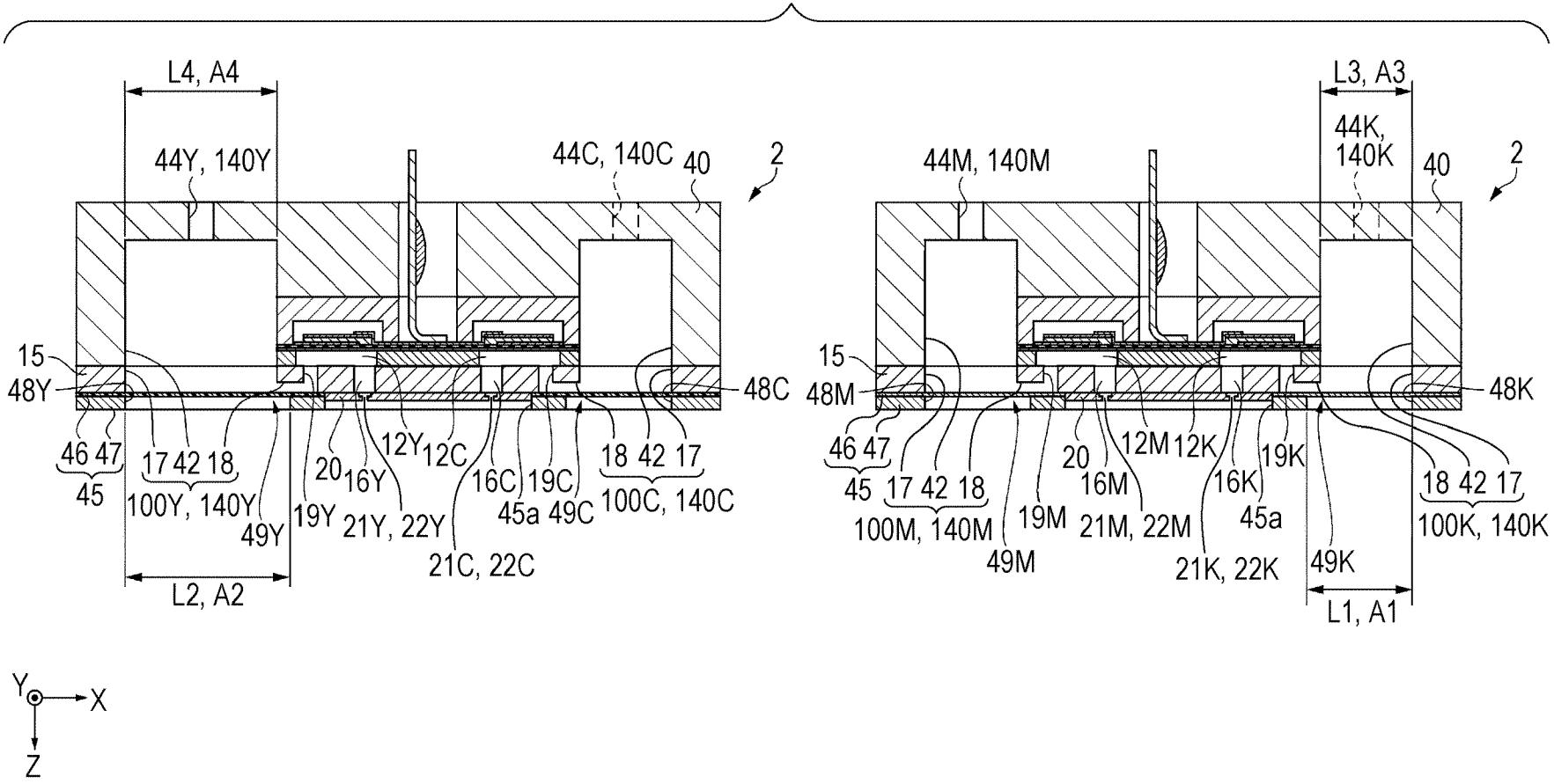
FIG. 9 is a sectional view taken along line IX-IX in FIG. 8.

FIG. 9 is a sectional view taken along line IX-IX in FIG. 8 and is a sectional view of the main portion of the head main body 2 including the nozzle row set 23 constituting the nozzle group L.

Here, the compliance capacity and the flow path resistance of the supply flow path 140 of each nozzle row set 23 will be described with reference to FIGS. 8 and 9.

As illustrated in FIGS. 8 and 9, in the X direction, a length L2 of the compliance portion 49Y of the nozzle row set 23Y having the long inter-nozzle row distance N is longer than a length L1 of the compliance portion 49K of the nozzle row set 23K having the short inter-nozzle row distance N. In addition, the size of a second opening portion 48Y corresponding to the compliance portion 49Y is larger than the size of a second opening portion 48K corresponding to the compliance portion 49K. Accordingly, an area A2 of the compliance portion 49Y provided in the common flow path 100Y of the nozzle row set 23Y having the long inter-nozzle row distance N is larger than an area A1 of the compliance portion 49K provided in the common flow path 100K of the nozzle row set 23K having the short inter-nozzle row distance N.

As described above, the compliance capacity increases when the area of the region where the flexible member can be deformed (area of the compliance portion 49) increases. Accordingly, in the present embodiment, the compliance capacity of the supply flow path 140Y is larger than the compliance capacity of the supply flow path 140K.

The area A1 of the compliance portion 49K is an example of "area of the first compliance portion" and the area A2 of the compliance portion 49Y is an example of "area of the second compliance portion".

In the X direction, a length L4 of the common flow path 100Y of the nozzle row set 23Y having the long inter-nozzle row distance N is longer than a length L3 of the common flow path 100K of the nozzle row set 23K having the short inter-nozzle row distance N. When viewed from the Y direction, a cross-sectional area A4 of the common flow path 100Y of the nozzle row set 23Y having the long inter-nozzle row distance N is larger than a cross-sectional area A3 of the common flow path 100K of the nozzle row set 23K having the short inter-nozzle row distance N.

Accordingly, the flow path resistance of the common flow path 100Y of the nozzle row set 23Y having the long inter-nozzle row distance N is smaller than the flow path resistance of the common flow path 100K of the nozzle row set 23K having the short inter-nozzle row distance N, and the flow path resistance of the supply flow path 140Y is smaller than the flow path resistance of the supply flow path 140K. In this manner, the present embodiment has a configuration in which the supply flow path 140Y through which the yellow (Y) ink is supplied from the liquid supply source 110Y to the pressure chamber 12Y is smaller in flow path resistance than the supply flow path 140K through which the black (K) ink is supplied from the liquid supply source 110K to the pressure chamber 12K.

The cross-sectional area A3 of the common flow path 100K is an example of "cross-sectional area of the first common flow path" and the cross-sectional area A4 of the common flow path 100Y is an example of "cross-sectional area of the second common flow path".

"Flow path resistance" in the present application is resistance hindering the flow of a liquid when the liquid is allowed to flow through a flow path. When the flow path resistance increases, the liquid becomes less likely to flow through the flow path. When the flow path resistance decreases, the liquid becomes more likely to flow through the flow path.

The flow path resistance decreases as the cross-sectional area of the flow path increases, that is, as the area of a surface perpendicular to the flow direction of the liquid flowing through the flow path increases. In addition, the pressure loss of the flow path is proportional to the magnitude of the flow path resistance, the pressure loss of the flow path increases as the flow path resistance increases, and the pressure loss of the flow path decreases as the flow path resistance decreases.

The cross-sectional area A4 of the common flow path 100Y as viewed from the Y direction and the cross-sectional area A3 of the common flow path 100K as viewed from the Y direction may be changed by the dimensions in the Z-direction of the common flow paths 100Y and 100K being changed.

In the liquid ejecting head 1 of the present embodiment, the nozzle rows 22 as a pair constituting the nozzle row set 23 ejecting ink of the same color are arranged symmetrically about the reference line C. The plurality of nozzle row sets 23 is provided for the respective ink colors. The liquid ejecting apparatus IJP having the carriage 3 on which the liquid ejecting head 1 is mounted performs printing operation while causing the liquid ejecting head 1 (carriage 3) to reciprocate in the X direction relative to the printing region of the medium S. As a result, the order of landing of the ink of each color with respect to the medium S can be the same in forward and return paths, and high-quality printing can be performed.

The liquid ejecting head 1 reciprocates in the X direction between the non-printing region that is provided on the +X direction side and the non-printing region that is provided on the −X direction side with respect to the printing region of the medium S.

In other words, when the liquid ejecting head 1 ejects ink while moving in the +X direction from the non-printing region provided on the −X direction side to the non-printing region provided on the +X direction side, the ink ejection is sequentially started from the nozzle row 22 first overlapping the printing region of the medium S in the Z direction. In other words, when the liquid ejecting head 1 performs printing operation while moving in the +X direction, ink ejection is started from the nozzle row 22 provided on the +X direction side. Specifically, when the liquid ejecting head 1 performs printing operation while moving in the +X direction, ink ejection is started in the order of the nozzle row 22RY, the nozzle row 22RC, the nozzle row 22RM, the nozzle row 22RK, the nozzle row 22LK, the nozzle row 22LM, the nozzle row 22LC, and the nozzle row 22LY.

When the liquid ejecting head 1 ejects ink while moving in the −X direction from the non-printing region provided on the +X direction side to the non-printing region provided on the −X direction side, the ink ejection is sequentially started from the nozzle row 22 first overlapping the printing region of the medium S in the Z direction. In other words, when the liquid ejecting head 1 performs printing operation while moving in the −X direction, ink ejection is started from the nozzle row 22 provided on the −X direction side. Specifically, when the liquid ejecting head 1 performs printing operation while moving in the −X direction, ink ejection is started in the order of the nozzle row 22LY, the nozzle row 22LC, the nozzle row 22LM, the nozzle row 22LK, the nozzle row 22RK, the nozzle row 22RM, the nozzle row 22RC, and the nozzle row 22RY.

Accordingly, when the liquid ejecting head 1 performs printing operation while moving in, for example, the +X direction, there is a difference between the timing at which the nozzle row 22 of the nozzle group R first starting ink ejection in the nozzle row set 23 starts ink ejection and the timing at which the nozzle row 22 of the nozzle group L later starting ink ejection in the nozzle row set 23 starts ink ejection.

Hereinafter, the difference between the timing at which the nozzle row 22 of the nozzle group R first starting ink ejection in the nozzle row set 23 starts ink ejection and the timing at which the nozzle row 22 of the nozzle group L later starting ink ejection in the nozzle row set 23 starts ink ejection will be abbreviated as the timing difference.

The timing difference in the nozzle row set 23 is relatively large in the nozzle row set 23 having the long inter-nozzle row distance N than in the nozzle row set 23 having the short inter-nozzle row distance N. Specifically, when the liquid ejecting head 1 performs printing operation while moving in the +X direction, the timing difference in the nozzle row set 23 becomes larger in the order of the nozzle row set 23Y, the nozzle row set 23C, the nozzle row set 23M, and the nozzle row set 23K.

As a result of ink ejection starting from the nozzle row 22 of the nozzle group R first starting ink ejection, ink flows from the liquid supply source 110 toward the nozzle row 22 of the nozzle group R via the supply flow path 140 on the nozzle group R side. Accordingly, the negative pressure in the supply flow path 140 on the nozzle group R side increases as a result of the ink ejection. In this configuration, the nozzle rows 22 as the pair constituting the nozzle row set 23 communicate with each other via the branch flow path 531 of the supply flow path 140 and ink is supplied from the common liquid supply source 110, and thus the negative pressure (pressure fluctuation) resulting from the ink ejection from the nozzle row 22 of the nozzle group R acts on the supply flow path 140 on the nozzle group L side until the nozzle row 22 of the nozzle group L starts ink ejection and the negative pressure of the supply flow path 140 on the nozzle group L side is increased. In other words, the negative pressure (pressure fluctuation) resulting from the ink ejection from the nozzle row 22 of the nozzle group R is accumulated in the supply flow path 140 on the nozzle group L side and the negative pressure of the supply flow path 140 on the nozzle group L side is increased.

Further, the negative pressure resulting from the ink ejection from the nozzle row 22 of the nozzle group R acts on the supply flow path 140 on the nozzle group L side for a longer period and the negative pressure of the supply flow path 140 on the nozzle group L side is further increased, when the timing difference in the nozzle row set 23 is larger than when the timing difference in the nozzle row set 23 is small. In this manner, the negative pressure (pressure fluctuation) of the supply flow path 140 on the nozzle group L side is enormous, as compared with the nozzle row set 23K having the short inter-nozzle row distance N (nozzle row set 23K having a small timing difference), in the nozzle row set 23Y having the long inter-nozzle row distance N (nozzle row set 23Y having a large timing difference).

When a small amount of ink is ejected from the nozzle row 22 of the nozzle group R first starting ink ejection, the negative pressure (pressure fluctuation) resulting from the ink ejection from the nozzle row 22 of the nozzle group R is slight. Accordingly, the negative pressure (pressure fluctuation) of the supply flow path 140Y on the nozzle group L side becomes slight and no adverse effect arises with respect to the nozzle row 22 of the nozzle group L later starting ink ejection.

In other words, when a small amount of ink is ejected from the nozzle row 22 of the nozzle group R first starting ink ejection, the negative pressure (pressure fluctuation) of the supply flow path 140 on the nozzle group L side becomes slight and the nozzle row 22 of the nozzle group L later starting ink ejection ejects ink in an appropriate manner both when the timing difference in the nozzle row set 23 is small and when the timing difference in the nozzle row set 23 is large.

When a large amount of ink is ejected from the nozzle row 22 of the nozzle group R first starting ink ejection, the negative pressure (pressure fluctuation) resulting from the ink ejection from the nozzle row 22RK of the nozzle group R acts on the supply flow path 140K on the nozzle group L side for a short period in the nozzle row set 23K having the small timing difference. Accordingly, the negative pressure (pressure fluctuation) of the supply flow path 140K on the nozzle group L side is slight and the nozzle row 22LK of the nozzle group L later starting ink ejection ejects ink in an appropriate manner.

When a large amount of ink is ejected from the nozzle row 22 of the nozzle group R first starting ink ejection, the negative pressure (pressure fluctuation) resulting from the ink ejection from the nozzle row 22RY of the nozzle group R acts on the supply flow path 140Y on the nozzle group L side for a long period in the nozzle row set 23Y having the large timing difference. Accordingly, the negative pressure (pressure fluctuation) of the supply flow path 140Y on the nozzle group L side becomes enormous, it becomes difficult for the nozzle row 22LY of the nozzle group L later starting ink ejection to eject ink in an appropriate manner, ink discharge becomes unstable, and a problem such as defective printing may arise.

Specifically, when a large amount of ink is ejected from the nozzle row 22RY of the nozzle group R first starting ink ejection in the nozzle row set 23Y having the long inter-nozzle row distance N as in the case of solid printing during which ink is ejected from the entire nozzle row 22RY of the nozzle group R, the effect from the nozzle row 22RY of the nozzle group R first starting ink ejection increases, the negative pressure of the supply flow path 140Y on the nozzle group L side becomes enormous, the meniscus of the nozzle 21Y of the nozzle row 22LY later starting ink ejection may be drawn inward, the meniscus may be damaged, ink discharge may become unstable, and a problem such as defective printing may arise.

In the liquid ejecting head 1 of the present embodiment, the compliance capacity of the supply flow path 140Y corresponding to the nozzle row set 23Y having the relatively long inter-nozzle row distance N is larger than the compliance capacity of the supply flow path 140K corresponding to the nozzle row set 23K having the relatively short inter-nozzle row distance N.

Accordingly, since the compliance capacity of the supply flow path 140Y of the nozzle row set 23Y having the relatively long inter-nozzle row distance N is large, the negative pressure (pressure fluctuation) generated in the supply flow path 140Y on the nozzle group R side is alleviated in an appropriate manner, the negative pressure (pressure fluctuation) of the supply flow path 140Y on the nozzle group L side later starting ejection becomes slight, the nozzle row 22LY of the nozzle row set 23Y later starting ink ejection discharges ink in an appropriate manner, and a problem such as defective printing is reduced, even when a large negative pressure (pressure fluctuation) is generated in the supply flow path 140Y on the nozzle group R side first starting ejection in the nozzle row set 23Y having the relatively long inter-nozzle row distance N.

In the present embodiment, the supply flow path 140Y through which the yellow (Y) ink is supplied has an increased compliance capacity, and each of the supply flow path 140K through which the black (K) ink is supplied, the supply flow path 140M through which the magenta (M) ink is supplied, and the supply flow path 140C through which the cyan (C) ink is supplied has a decreased compliance capacity.

Since only the compliance capacity of the supply flow path 140Y of the nozzle row set 23Y having the relatively long inter-nozzle row distance N is increased as described above, the liquid ejecting head 1 can be reduced in size and the liquid ejecting apparatus IJP provided with the liquid ejecting head 1 can be reduced in size as compared with a case where the compliance capacity of every supply flow path 140 of the nozzle row set 23 is increased.

In the present embodiment, the compliance portion 49 is provided for each supply flow path 140 and the compliance capacity can be adjusted for each supply flow path 140. Accordingly, the compliance capacity may be reduced in the descending order of, for example, the compliance capacity of the supply flow path 140Y through which the yellow (Y) ink is supplied, the compliance capacity of the supply flow path 140C through which the cyan (C) ink is supplied, the compliance capacity of the supply flow path 140M through which the magenta (M) ink is supplied, and the compliance capacity of the supply flow path 140K through which the black (K) ink is supplied. In other words, the compliance capacity may be optimized for each supply flow path 140 by the compliance capacity of the supply flow path 140 being reduced in descending order of the inter-nozzle row distance N.

Here, the relationship between a meniscus withstand pressure P1 of the nozzle 21 of the nozzle row 22 of the nozzle group L and a pressure loss P2 of the supply flow path 140 on the nozzle group L side will be described.

The meniscus withstand pressure P1 is a pressure at which the meniscus of the nozzle 21 can be withstood such that the meniscus is not drawn into the nozzle 21 when a pressure to draw the meniscus of the nozzle 21 into the nozzle 21 acts on the meniscus of the nozzle 21. For example, the meniscus of the nozzle 21 is not drawn inward and the meniscus is not damaged when the pressure that acts on the ink in the nozzle 21 is smaller than the meniscus withstand pressure P1. When the pressure that acts on the ink in the nozzle 21 is larger than the meniscus withstand pressure P1, the meniscus of the nozzle 21 is drawn inward and the meniscus is damaged.

The pressure loss P2 is caused by ink flowing through the supply flow path 140. The pressure loss P2 of the supply flow path 140 decreases when the flow path resistance of the supply flow path 140 decreases. The pressure loss P2 of the supply flow path 140 increases when the flow path resistance of the supply flow path 140 increases.

Further, when the negative pressure that the pressure adjustment unit of the liquid supply source 110 generates in the supply flow path 140 is P3, the negative pressure that acts on the supply flow path 140 on the nozzle group L side when solid printing is performed by the nozzle row 22 of the nozzle group R first starting ink ejection is P4, and the meniscus withstand pressure P1 satisfies the following Expression (1), the meniscus of the nozzle 21Y is not damaged in the nozzle row 22 of the nozzle group L later starting ink ejection and a problem such as defective printing is reduced.

$$P|1|>|P2+P3+P4| \quad (1)$$

When a large amount of ink is ejected from the nozzle row set 23Y as described above, the negative pressure P4 acting on the supply flow path 140Y on the nozzle group L side increases in the nozzle row set 23Y having the long inter-nozzle row distance N. Accordingly, Expression (1) is not satisfied, the meniscus of the nozzle 21Y of the nozzle row 22LY may be damaged, and a problem such as defective printing may arise.

In the liquid ejecting head 1 of the present embodiment, the flow path resistance of the supply flow path 140Y corresponding to the nozzle row set 23Y having the relatively long inter-nozzle row distance N is smaller than the flow path resistance of the supply flow path 140K corresponding to the nozzle row set 23K having the relatively short inter-nozzle row distance N. In other words, the liquid ejecting head 1 of the present embodiment has a configuration in which the flow path resistance of the supply flow path 140Y is smaller than the flow path resistance of the supply flow path 140K.

Accordingly, the pressure loss P2 in the nozzle row set 23Y having the relatively long inter-nozzle row distance N is smaller than the pressure loss P2 in the nozzle row set 23K having the relatively short inter-nozzle row distance N.

In such a configuration, the pressure loss P2 in the nozzle row set 23Y having the relatively long inter-nozzle row distance N is small, and thus Expression (1) can be satisfied even when the amount of the ink that is ejected from the nozzle row set 23Y increases and the large negative pressure P4 (pressure fluctuation) acts on the supply flow path 140Y on the nozzle group L side. As a result, the meniscus of the nozzle 21Y is not damaged and ink is discharged in an appropriate manner from the nozzle 21Y in the nozzle row 22LY of the nozzle group L later starting ink ejection and a problem such as defective printing is reduced.

In other words, Expression (1) can be satisfied with the configuration in which the flow path resistance of the supply flow path 140Y is smaller than the flow path resistance of the supply flow path 140K. As a result, the meniscus of the nozzle 21Y is not damaged and ink is discharged in an appropriate manner from the nozzle 21Y in the nozzle row 22LY of the nozzle group L later starting ink ejection and a problem such as defective printing is reduced.

Further, the flow path resistance can be optimized for each supply flow path 140 of each nozzle row set 23 since the supply flow path 140K of the nozzle row set 23K having the relatively short inter-nozzle row distance N has an increased flow path resistance and the supply flow path 140Y of the nozzle row set 23Y having the relatively long inter-nozzle row distance N has a decreased flow path resistance. In other words, the liquid ejecting head 1 can be reduced in size and the liquid ejecting apparatus IJP provided with the liquid ejecting head 1 can be reduced in size by the cross-sectional area of the supply flow path 140 being optimized for each nozzle row set 23.

Effects of the liquid ejecting head 1 according to the present embodiment and the liquid ejecting apparatus IJP provided with the liquid ejecting head 1 will be described below.

1) Since the compliance capacity of the supply flow path 140Y of the nozzle row set 23Y having the long inter-nozzle row distance N is larger than the compliance capacity of the supply flow path 140K of the nozzle row set 23K having the short inter-nozzle row distance N, problems such as inward drawing of the meniscus of the nozzle 21Y, damage to the meniscus of the nozzle 21Y, and defective printing are reduced.

2) Since the flow path resistance of the supply flow path 140Y of the nozzle row set 23Y having the long inter-nozzle row distance N is smaller than the flow path resistance of the supply flow path 140K of the nozzle row set 23K having the short inter-nozzle row distance N, problems such as inward drawing of the meniscus of the nozzle 21Y, damage to the meniscus of the nozzle 21Y, and defective printing are reduced.

3) Since the area A2 of the compliance portion 49Y provided in the common flow path 100Y of the nozzle row set 23Y having the long inter-nozzle row distance N is larger than the area A1 of the compliance portion 49K provided in the common flow path 100K of the nozzle row set 23K having the short inter-nozzle row distance N, the compliance capacity of the supply flow path 140Y of the nozzle row set 23Y having the long inter-nozzle row distance N is larger than the compliance capacity of the supply flow path 140K of the nozzle row set 23K having the short inter-nozzle row distance N and problems such as inward drawing of the meniscus of the nozzle 21Y, damage to the meniscus of the nozzle 21Y, and defective printing are reduced.

4) When the cross-sectional area A4 of the common flow path 100Y of the nozzle row set 23Y having the long inter-nozzle row distance N as viewed from the Y direction (nozzle row direction) is larger than the cross-sectional area A3 of the common flow path 100K of the nozzle row set 23K having the short inter-nozzle row distance N as viewed from the Y direction (nozzle row direction), the flow path resistance of the supply flow path 140Y of the nozzle row set 23Y having the long inter-nozzle row distance N is smaller than the flow path resistance of the supply flow path 140K of the nozzle row set 23K having the short inter-nozzle row distance N, and thus problems such as inward drawing of the meniscus of the nozzle 21Y, damage to the meniscus of the nozzle 21Y, and defective printing can be reduced.

5) The liquid ejecting head 1 has the plurality of nozzle row sets 23 ejecting different colors of ink and the nozzle rows 22 as the pair constituting the nozzle row set 23 ejecting ink of the same color are arranged symmetrically about the reference line C. Accordingly, even when printing operation is performed by ink being ejected from the liquid ejecting head 1 while the carriage 3 reciprocates in the X direction, the order of landing of the liquid of each color with respect to the medium S can be aligned in the forward and return paths of the carriage 3 and high-quality printing can be performed.

The present disclosure is not limited to the embodiment described above and can be appropriately changed within the spirit or idea of the disclosure that can be read from the claims and the entire specification. Various modification examples other than the embodiment described above are conceivable. The modification examples will be described below.

Modification Example 1

Figure 10:
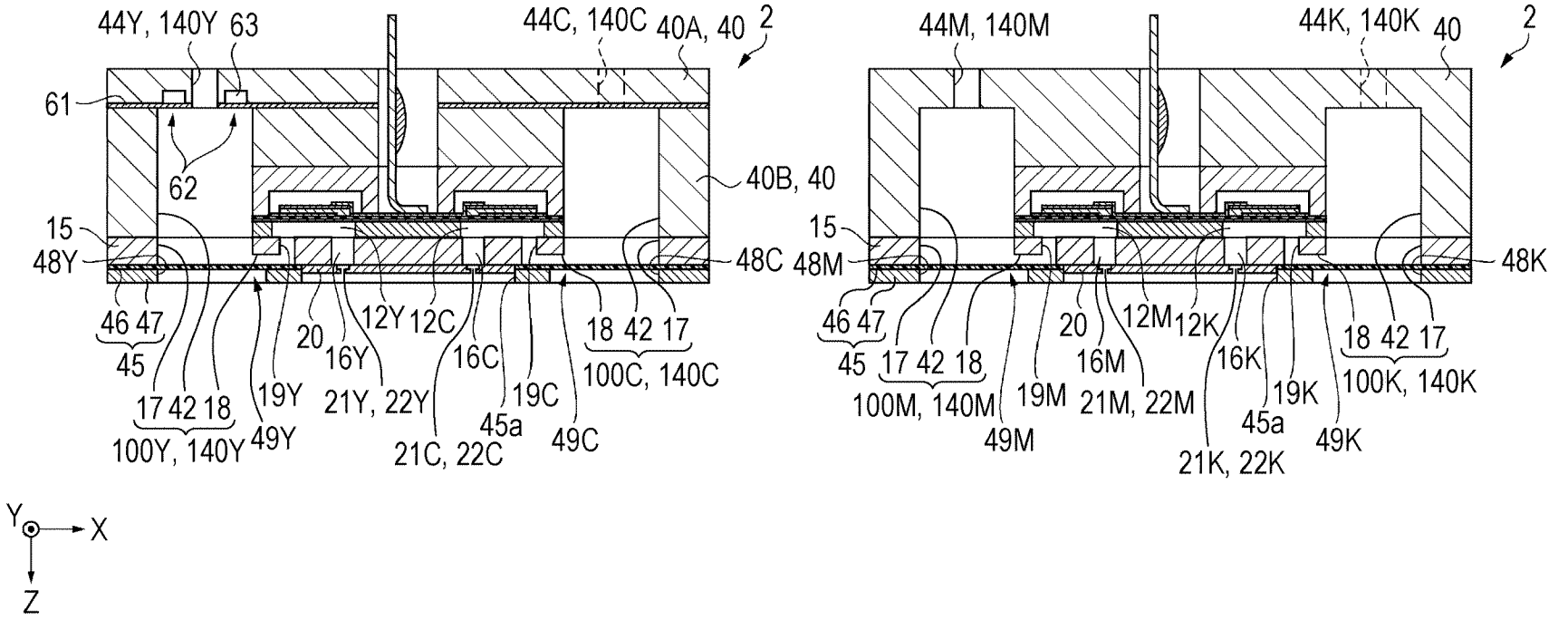
FIG. 10 is a sectional view of a head main body according to Modification Example 1.

FIG. 10, which corresponds to FIG. 9, is a sectional view of the main portion of the head main body 2 of Modification Example 1.

In the embodiment, each common flow path 100 is provided with one compliance portion 49. In the present modification example, the common flow path 100Y of the nozzle row set 23Y having the long inter-nozzle row distance N is provided with a new compliance portion 62 as well as the compliance portion 49Y. The compliance portion 62 is provided on the top surface of the common flow path 100Y.

This is the main difference between the present modification example and the embodiment.

Hereinafter, the head main body 2 according to the present modification example will be described with reference to FIG. 10. The following description will focus on the difference from the embodiment. Components identical to those of the embodiment will be denoted by the same reference numerals and redundant description will be omitted.

As illustrated in FIG. 10, in the present modification example, a case member 40A provided on the −Z direction side and a case member 40B provided on the +Z direction side constitute the case member 40 of the head main body 2 having the nozzle row set 23Y having the long inter-nozzle row distance N. A sealing film 61 made of a flexible member is sandwiched between the case member 40A and the case member 40B. The sealing film 61 is provided with a through hole penetrating the sealing film 61 in the Z direction and the through hole is at a position overlapping the inlet ports 44Y and 44C and the coupling port 43 in the Z direction. The through hole is provided in the sealing film 61 so that ink is introduced and the wiring substrate 121 is disposed.

A recess 63 recessed in the −Z direction is provided on the +Z direction side of the case member 40A and at a part overlapping the common flow path 100Y when viewed from the Z direction. The inlet port 44Y and the periphery that defines the inlet port 44Y are not provided with the recess 63. The recess 63 of the case member 40A forms a space necessary for the sealing film 61 to be flexurally deformed in the −Z direction. In other words, the sealing film 61 can be flexurally deformed in the recess 63. A through hole (not illustrated) allows the space that is formed by the sealing film 61 and the recess 63 to communicate with the atmosphere.

The sealing film 61 that can be flexurally deformed in the recess 63, that is, the flexurally deformable part of the sealing film 61 on the top surface of the common flow path 100Y is the compliance portion 62.

As described above, in the present modification example, the common flow path 100Y of the nozzle row set 23Y having the long inter-nozzle row distance N is provided with the new compliance portion 62 as well as the compliance portion 49Y having the same configuration as in the embodiment. Accordingly, in the present modification example, the area of the flexurally deformable part in the common flow path 100Y increases and the compliance capacity increases as compared with the embodiment. Accordingly, problems such as inward drawing of the meniscus of the nozzle 21Y, damage to the meniscus of the nozzle 21Y, and defective printing become even less likely to arise.

Modification Example 2

Figure 11:
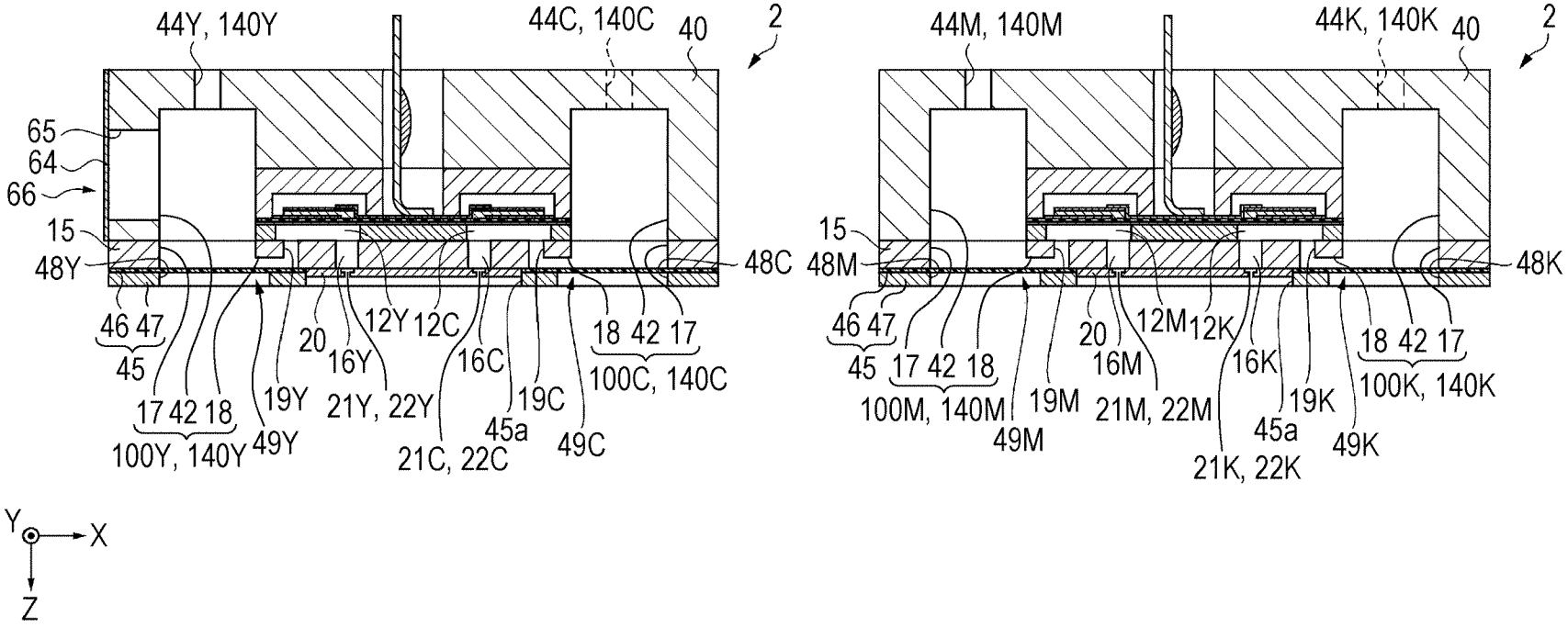
FIG. 11 is a sectional view of a head main body according to Modification Example 2.

FIG. 11, which corresponds to FIG. 9, is a sectional view of the main portion of the head main body 2 of Modification Example 2.

In the embodiment described above, each common flow path 100 is provided with one compliance portion 49. In the present modification example, the common flow path 100Y of the nozzle row set 23Y having the long inter-nozzle row distance N is provided with a new compliance portion 66 as well as the compliance portion 49Y. The compliance portion 66 is provided on the side surface of the common flow path 100Y.

This is the main difference between the present modification example and the embodiment.

Hereinafter, the head main body 2 according to the present modification example will be described with reference to FIG. 11. The following description will focus on the difference from the embodiment. Components identical to those of the embodiment will be denoted by the same reference numerals and redundant description will be omitted.

In the present modification example, an opening portion 65 open in the −X direction is provided in the −X direction-side end portion of the case member 40 of the head main body 2 having the nozzle row set 23Y having the long inter-nozzle row distance N. A sealing film 64 sealing the opening portion 65 from the outside is fixed to the opening portion 65 of the case member 40 by means of an adhesive or the like. The sealing film 64 can be flexurally deformed in the opening portion 65.

The sealing film 64 that can be flexurally deformed in the opening portion 65, that is, the flexurally deformable part of the sealing film 64 on the side surface of the common flow path 100Y is the compliance portion 66.

As described above, in the present modification example, the common flow path 100Y of the nozzle row set 23Y having the long inter-nozzle row distance N is provided with the new compliance portion 66 as well as the compliance portion 49Y having the same configuration as in the embodiment. Accordingly, in the present modification example, the area of the flexurally deformable part in the common flow path 100Y increases and the compliance capacity increases as compared with the embodiment. Accordingly, problems such as inward drawing of the meniscus of the nozzle 21Y, damage to the meniscus of the nozzle 21Y, and defective printing become even less likely to arise.

The compliance portion in the common flow path 100Y may be provided on the bottom surface of the common flow path 100Y as in the embodiment, may be provided on the bottom surface and the top surface of the common flow path 100Y as in Modification Example 1, or may be provided on the bottom surface and the side surface of the common flow path 100Y as in Modification Example 2. Further, the compliance portion in the common flow path 100Y may be provided on the bottom surface, the top surface, and the side surface of the common flow path 100Y.

Likewise, the other common flow paths 100C, 100M, and 100K may be provided with new compliance portions on the top surfaces of the common flow paths 100C, 100M, and 100K or the side surfaces of the common flow paths 100C, 100M, and 100K in addition to the compliance portions 49C, 49M, and 49K on the bottom surfaces of the common flow paths 100C, 100M, and 100K. For example, by the new compliance portions being provided on the top surfaces of the common flow paths 100C, 100M, and 100K or the side surfaces of the common flow paths 100C, 100M, and 100K, the compliance portions 49C, 49M, and 49K provided on the bottom surfaces of the common flow paths 100C, 100M, and 100K can be made relatively small and the liquid ejecting head 1 can be reduced in size.

Modification Example 3

In the embodiment, the compliance portion 49 is provided in the head main body 2. The compliance portion may be provided outside the head main body 2. Specifically, the compliance portion may be provided at any place upstream of the inlet port 44 provided in the case member 40 of the head main body 2 (closer to the liquid supply source 110 side than the inlet port 44) and downstream of the first vertical flow path 511 provided in the first flow path member 210 of the flow path member 200 (closer to the nozzle 21 side than the first vertical flow path 511).

Figure 12:
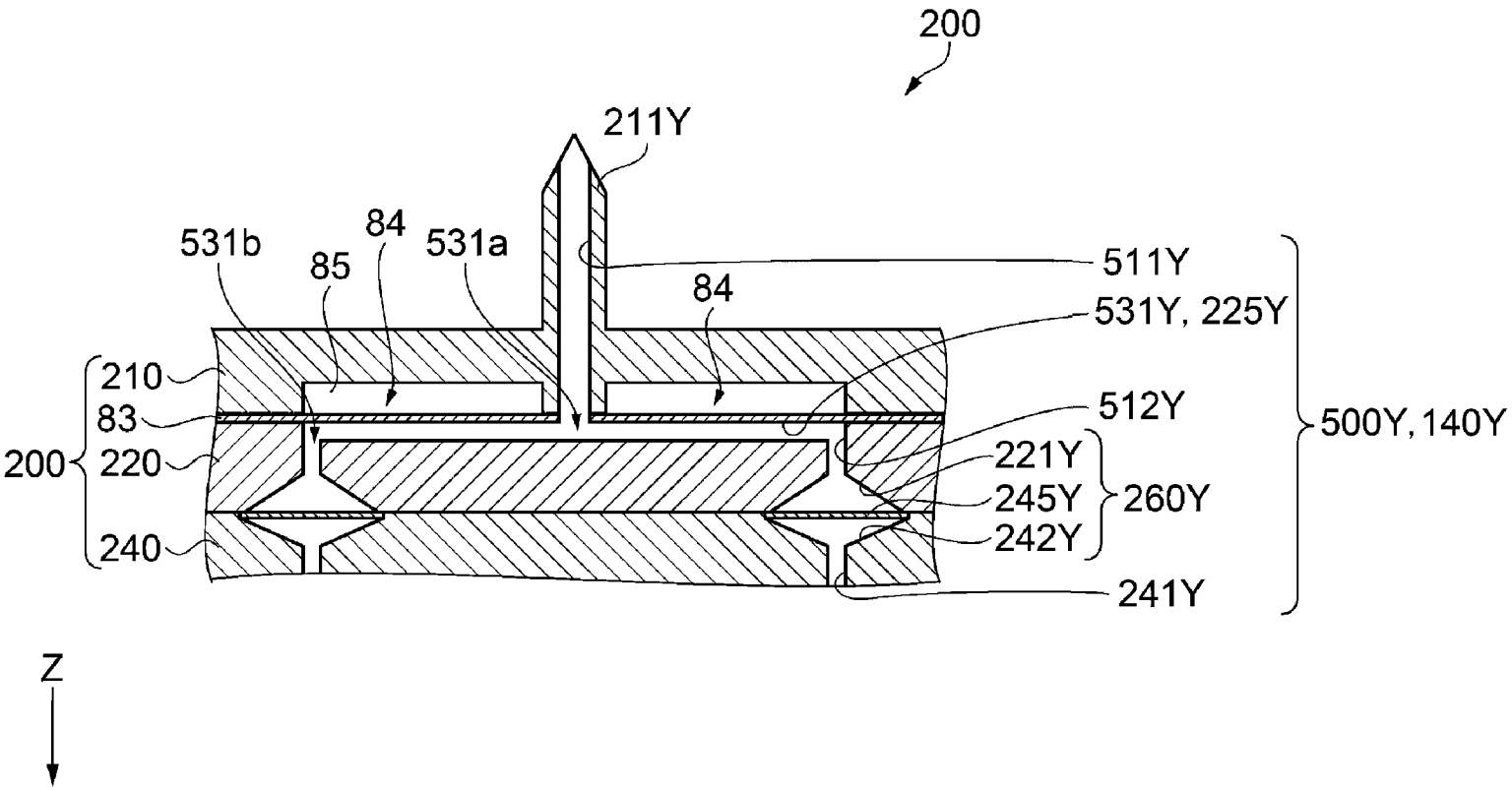
FIG. 12 is a sectional view of the main portion of a flow path member according to Modification Example 3.

FIG. 12, which corresponds to FIG. 6, is a sectional view of the main portion of the flow path member 200 according to Modification Example 3. Illustrated in FIG. 12 is a state of the liquid flow path 500Y that is provided in the flow path member 200 and allows the yellow (Y) ink to flow through the liquid flow path 500Y.

An example of a case where a compliance portion is provided in the flow path member 200 will be described below with reference to FIG. 12.

As illustrated in FIG. 12, the flow path member 200 in the present modification example is provided with a compliance portion 84 in a branch flow path 531Y of the liquid flow path 500Y. The compliance portion 84 is an example of "third compliance portion".

A flexible sealing film 83 is sandwiched between the first flow path member 210 and the second flow path member 220. As described above, the groove 225 is formed in the surface of the second flow path member 220 that is on the first flow path member 210 side (see FIG. 5). The branch flow path 531Y of the liquid flow path 500Y is formed by being joined to the first flow path member 210 by the groove 225 of the second flow path member 220 being sealed by the sealing film 83. In other words, the sealing film 83 constitutes a part of the wall surface of the branch flow path 531Y.

Hereinafter, the part of the sealing film 83 that becomes the wall surface of the branch flow path 531Y will be referred to as the sealing film 83 of the branch flow path 531Y.

A recess 85 recessed in the −Z direction is provided on the +Z direction side of the first flow path member 210. The recess 85 is at a position overlapping the sealing film 83 of the branch flow path 531Y when viewed from the Z direction. A first vertical flow path 511Y and the first flow path member 210 in the periphery that defines the first vertical flow path 511Y are not provided with the recess 85.

The sealing film 83 of the branch flow path 531Y can be flexurally deformed by the recess 85 being provided. As a result, the flexurally deformable compliance portion 84 is formed in the branch flow path 531Y of the liquid flow path 500Y through which the yellow (Y) ink is supplied from the liquid supply source 110Y to the pressure chamber 12Y. In other words, the flexurally deformable region in the branch flow path 531Y formed by the sealing film 83 and the recess 85 is the compliance portion 84.

A through hole (not illustrated) allows the space that is formed by the sealing film 83 and the recess 85 to communicate with the atmosphere.

As described above, in the present modification example, the new compliance portion 84, which is an example of "third compliance portion", is provided outside the head main body 2 in addition to the compliance portion 49Y provided in the head main body 2. Accordingly, in the present modification example, the area of the flexurally deformable part in the supply flow path 140Y increases and the compliance capacity in the supply flow path 140Y increases as compared with the embodiment. Accordingly, problems such as inward drawing of the meniscus of the nozzle 21Y, damage to the meniscus of the nozzle 21Y, and defective printing become even less likely to arise.

As described above, the communication flow path 253Y formed in the projection portion 251 of the head case 250 allows the inlet port 44Y provided in the case member 40 of the head main body 2 and a third vertical flow path 241Y of the filter holding member 240 to communicate with each other.

A flexible member may constitute the projection portion 251 forming the communication flow path 253Y and the communication flow path 253Y may be provided with a flexurally deformable region.

Further, an elastic tube or the like may allow the third vertical flow path 241Y of the filter holding member 240 and the communication flow path 253Y of the projection portion 251 of the head case 250 to communicate with each other and the flow path between the third vertical flow path 241Y and the communication flow path 253Y may be provided with a flexurally deformable region.

The flexurally deformable region provided in the communication flow path 253Y and the flexurally deformable region provided in the flow path between the third vertical flow path 241Y and the communication flow path 253Y are new compliance portions alleviating pressure fluctuations in the supply flow path 140Y.

Further, the flow path between the inlet port 44 and the first vertical flow path 511 through which the cyan (C) ink flows may be provided with a new compliance portion alleviating pressure fluctuations in the supply flow path 140C, the flow path between the inlet port 44 and the first vertical flow path 511 through which the magenta (M) ink flows may be provided with a new compliance portion alleviating pressure fluctuations in the supply flow path 140M, and the flow path between the inlet port 44 and the first vertical flow path 511 through which the black (K) ink flows may be provided with a new compliance portion alleviating pressure fluctuations in the supply flow path 140K without limitation to the flow path between the inlet port 44 and the first vertical flow path 511 through which the yellow (Y) ink flows being provided with the new compliance portions alleviating pressure fluctuations in the supply flow path 140Y.

Modification Example 4

The flexible member constituting the compliance portion may be significantly deformed by the thicknesses, the materials, and the like of the compliance portion forming members (such as the sealing film 46, the sealing film 61, and the sealing film 83) being changed in the embodiment and the modification examples described above.

For example, the compliance capacity of the nozzle row set 23Y may be increased by the sealing film that forms the compliance portion of the nozzle row set 23Y being flexurally deformed to a significant extent by the sealing film (such as the sealing film 46, the sealing film 61, and the sealing film 83) that forms the compliance portion of the nozzle row set 23Y having the long inter-nozzle row distance N being reduced in thickness and the sealing film (such as the sealing film 46, the sealing film 61, and the sealing film 83) of the compliance portion of the nozzle row set 23K having the short inter-nozzle row distance being increased in thickness.

Further, the compliance capacity of the supply flow path 140Y may be increased by an elastic member constituting the member (such as the sealing film 46, the sealing film 61, and the sealing film 83) constituting the compliance portion and the compliance portion of the supply flow path 140Y through which the yellow (Y) ink flows being elastically deformed to a larger extent than the compliance portion of the supply flow path 140K through which the black (K) ink flows.

Even in such a configuration, the compliance capacity in the supply flow path 140Y is increased, and thus problems such as inward drawing of the meniscus of the nozzle 21Y, damage to the meniscus of the nozzle 21Y, and defective printing become even less likely to arise.

Further, the compliance capacity of the compliance portion may be changed by a flexible member different in rigidity being adopted as a sealing film for each nozzle row set 23.

Modification Example 5

In the embodiment, the flow path resistance of the common flow path 100 of the nozzle row set 23Y having the long inter-nozzle row distance N is smaller than the flow path resistance of the common flow path 100K of the nozzle row set 23K having the short inter-nozzle row distance N and the flow path resistance of the supply flow path 140Y is smaller than the flow path resistance of the supply flow path 140K.

The flow path resistance of the supply flow path 140Y other than the common flow path 100Y may be smaller than the flow path resistance of the flow path of the supply flow path 140K other than the common flow path 100K and the flow path resistance of the supply flow path 140Y of the nozzle row set 23Y having the long inter-nozzle row distance N may be smaller than the flow path resistance of the supply flow path 140K of the nozzle row set 23K having the short inter-nozzle row distance N.

Figure 13:
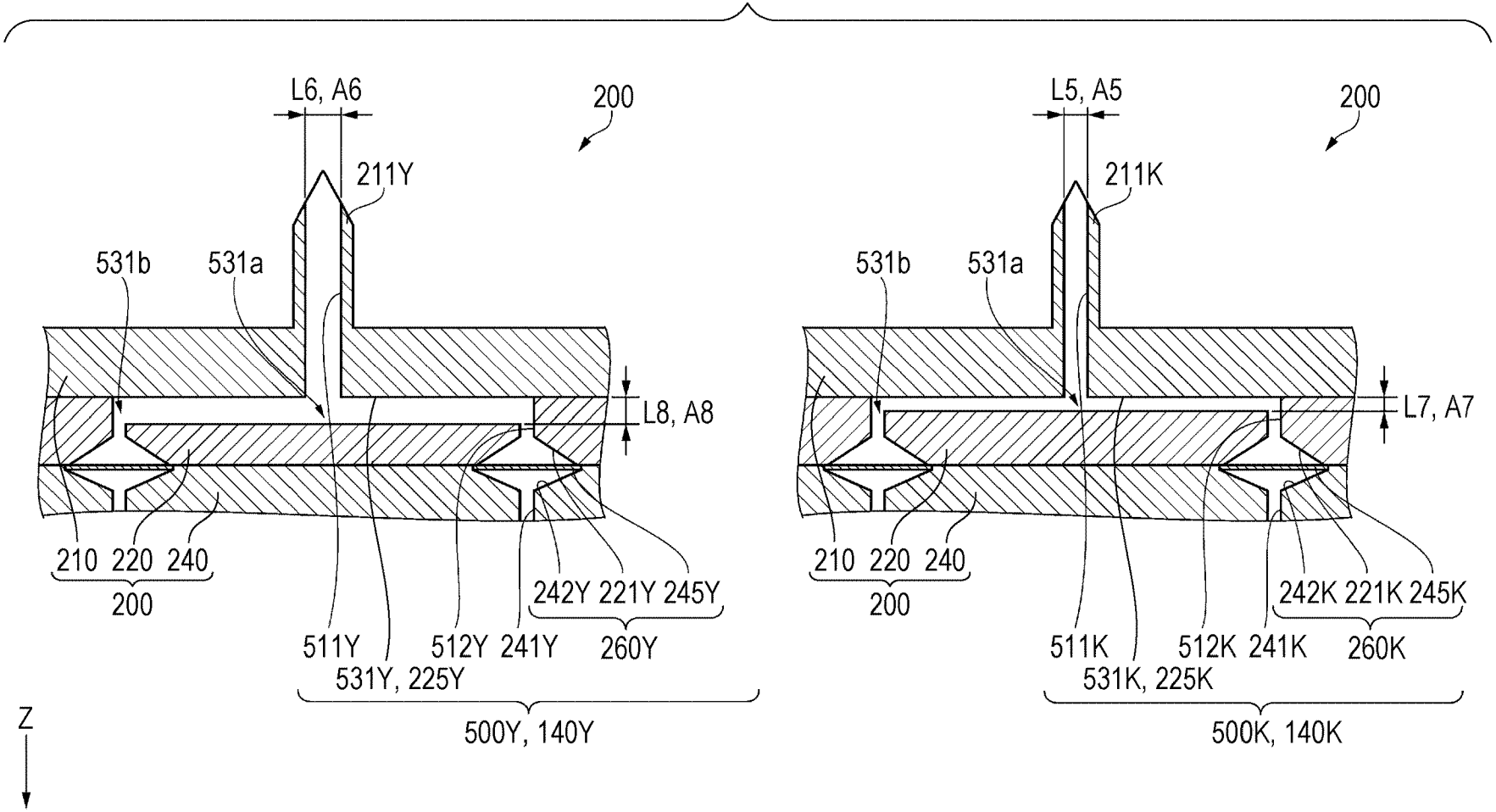
FIG. 13 is a sectional view of the main portion of a flow path member according to Modification Example 5.

FIG. 13, which corresponds to FIG. 6, is a sectional view of the main portion of the flow path member 200 according to Modification Example 5. In FIG. 13, a sectional view of the main portion of the liquid flow path 500Y is illustrated on the left side and a sectional view of the main portion of the liquid flow path 500K is illustrated on the right side.

An example in which the flow path resistance of the supply flow path 140Y other than the common flow path 100Y is smaller than the flow path resistance of the supply flow path 140K other than the common flow path 100K and the flow path resistance of the supply flow path 140Y is smaller than the flow path resistance of the supply flow path 140K will be described with reference to FIG. 13.

As illustrated in FIG. 13, a diameter L6 of the first vertical flow path 511Y provided in the coupling portion 211Y of the liquid flow path 500Y is larger than a diameter L5 of a first vertical flow path 511K provided in the coupling portion 211K of the liquid flow path 500K and an area A6 of the surface of the first vertical flow path 511Y in the coupling portion 211Y that is perpendicular to the flow direction of the yellow (Y) ink is larger than an area A5 of the surface of the first vertical flow path 511K in the coupling portion 211K that is perpendicular to the flow direction of the black (K) ink. Further, a diameter L8 of the branch flow path 531Y of the liquid flow path 500Y is larger than a diameter L7 of a branch flow path 531K of the liquid flow path 500K and an area A8 of the surface of the branch flow path 531Y that is perpendicular to the flow direction of the yellow (Y) ink is larger than an area A7 of the surface of the branch flow path 531K that is perpendicular to the flow direction of the black (K) ink.

In this manner, the areas A6 and A8 of the surfaces in the liquid flow path 500Y that are perpendicular to the flow direction of the yellow (Y) ink are larger than the areas A5 and A7 of the surfaces in the liquid flow path 500K that are perpendicular to the flow direction of the black (K) ink.

In such a configuration, the flow path resistance of the liquid flow path 500Y forming a part of the supply flow path 140Y is smaller than the flow path resistance of the liquid flow path 500K forming a part of the supply flow path 140K and the flow path resistance of the supply flow path 140Y is smaller than the flow path resistance of the supply flow path 140K. When the flow path resistance of the supply flow path 140Y of the nozzle row set 23Y having the long inter-nozzle row distance N is smaller than the flow path resistance of the supply flow path 140K of the nozzle row set 23K having the short inter-nozzle row distance N, problems such as inward drawing of the meniscus of the nozzle 21Y, damage to the meniscus of the nozzle 21Y, and defective printing become less likely to arise.

The flow path resistance of another flow path may be changed without limitation to the above-described configuration in which the flow path resistance of the first vertical flow path 511 or the flow path resistance of the branch flow path 531 is changed. In other words, the flow path resistance of the supply flow path 140 other than common flow path 100 may be changed by the area of the surface that is perpendicular to the ink flow direction being changed at any part of the supply flow path 140 other than the common flow path 100.

Modification Example 6

Figure 14:
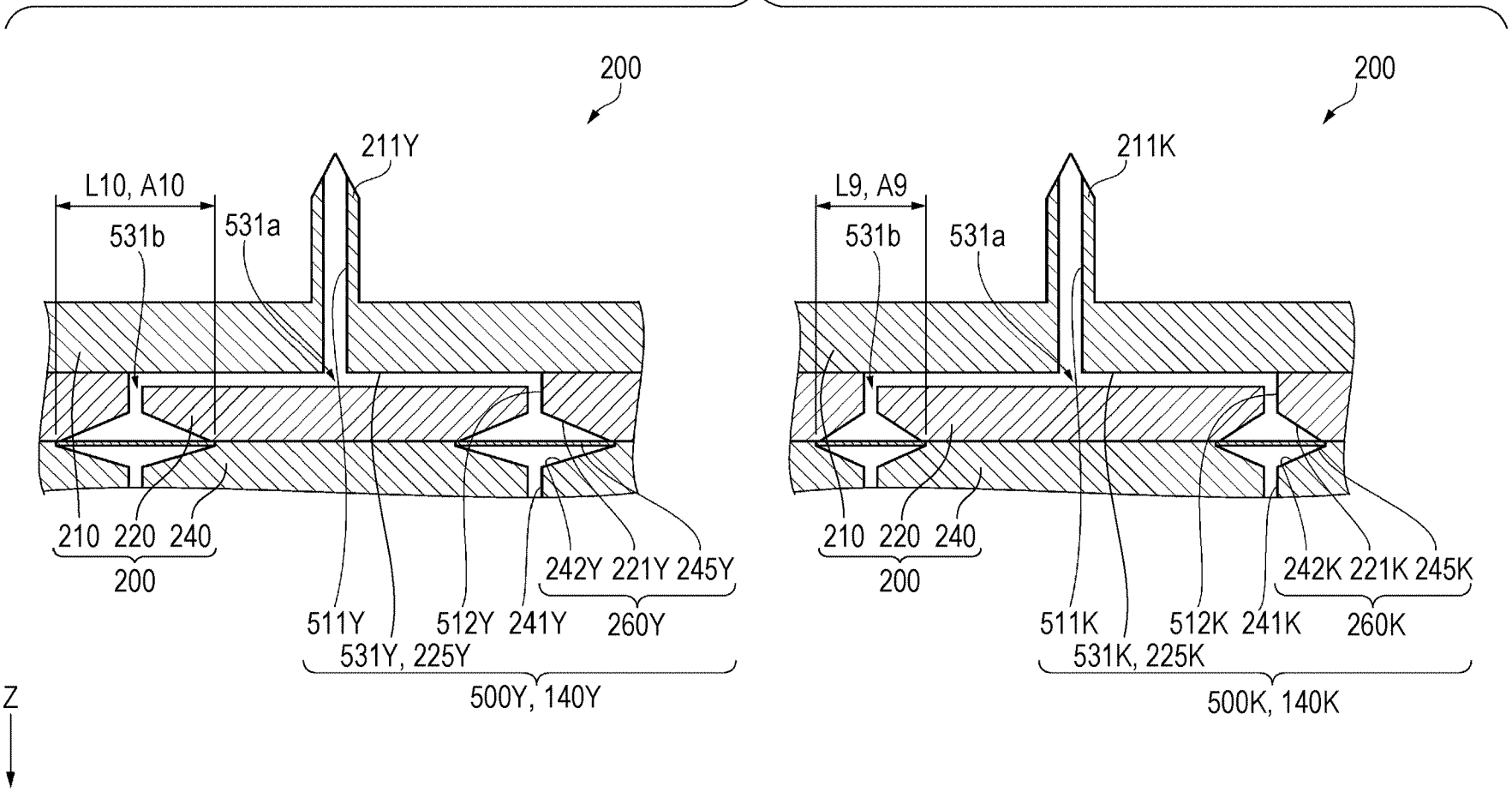
FIG. 14 is a sectional view of the main portion of a flow path member according to Modification Example 6.

FIG. 14, which corresponds to FIG. 6, is a sectional view of the main portion of the flow path member 200 according to Modification Example 6. In FIG. 14, a sectional view of the main portion of the liquid flow path 500Y is illustrated on the left side and a sectional view of the main portion of the liquid flow path 500K is illustrated on the right side.

As illustrated in FIG. 14, a diameter L10 of the filter 245Y is larger than a diameter L9 of the filter 245K and an area A10 of the filter 245Y provided in a filter chamber 260Y is larger than an area A9 of the filter 245K provided in a filter chamber 260K when viewed from the Z direction. The flow path resistance of the supply flow path 140Y is smaller than the flow path resistance of the supply flow path 140K.

Even in such a configuration, the flow path resistance of the supply flow path 140Y of the nozzle row set 23Y having the long inter-nozzle row distance N can be smaller than the flow path resistance of the supply flow path 140K of the nozzle row set 23K having the short inter-nozzle row distance N, and thus problems such as inward drawing of the meniscus of the nozzle 21Y, damage to the meniscus of the nozzle 21Y, and defective printing become less likely to arise.

Modification Example 7

The flow path resistance of the supply flow path 140 of the nozzle row set 23Y having the long inter-nozzle row distance N may be made smaller than the flow path resistance of the nozzle row set 23K having the short inter-nozzle row distance N by the filter 245Y corresponding to the nozzle row set 23Y having the long inter-nozzle row distance N being allowed to be coarser than the filter 245K corresponding to the nozzle row set 23K having the short inter-nozzle row distance N.

It is preferable to pass a type of ink having a large particle size such as a dye and a pigment through the filter 245Y of the nozzle row set 23Y having the long inter-nozzle row distance N. In present modification example, the filter 245Y of the nozzle row set 23Y having the long inter-nozzle row distance N is coarse, and thus the possibility of clogging of the filter 245Y can be reduced even when a liquid having large particles is passed through the filter 245Y.

Modification Example 8

The sizes of the plurality of liquid supply sources 110 mounted on the carriage 3, that is, the amounts of the ink that can be stored in the liquid supply sources 110 may vary. For example, the black liquid supply source 110, which is frequently used in general, may be larger in size than the liquid supply sources 110 for the other colors.

Further, when a pressure adjustment valve or the like is not provided between the liquid supply source 110 and the flow path member 200, the ink in the large-capacity liquid supply source 110 is more likely to undergo pressure fluctuations attributable to the reciprocation of the carriage 3 in the X direction (main scanning direction) than the ink in the small-capacity liquid supply source 110. In this case, it is preferable that the ink supplied to the nozzle row set 23 having the short inter-nozzle row distance N, which is ejected later and is small in the magnitude of the negative pressure P4 acting on the supply flow path 140 on the nozzle row 22 side, is supplied from the liquid supply source 110 capable of storing a large amount of ink.

With such a configuration, it is possible to reduce the adverse effect on the nozzle 21 that is attributable to the pressure fluctuations from the inner portion of the liquid supply source 110.

Modification Example 9

Although the supply flow path 140Y corresponding to the nozzle row set 23 having the longest inter-nozzle row distance N and the supply flow path 140K corresponding to the nozzle row set 23 having the shortest inter-nozzle row distance N differ from each other in terms of compliance capacity and flow path resistance in the embodiment, the present disclosure is not limited to the aspect. In other words, one or both of "the compliance capacity of the supply flow path 140 of the nozzle row set 23 having the longest inter-nozzle row distance N is larger than the compliance capacity of the supply flow path 140 of the nozzle row set 23 having the shortest inter-nozzle row distance N" and "the flow path resistance of the supply flow path 140 of the nozzle row set 23 having the longest inter-nozzle row distance N is smaller than the flow path resistance of the supply flow path 140 of the nozzle row set 23 having the shortest inter-nozzle row distance N" may be satisfied.

For example, when the number of the nozzle row sets 23 is three or more, the compliance capacity of the supply flow path 140 corresponding to the nozzle row set 23 other than the nozzle row set 23 having the longest inter-nozzle row distance N and the nozzle row set 23 having the shortest inter-nozzle row distance N may be equal to or less than the compliance capacity of the supply flow path 140 of the nozzle row set 23 having the longest inter-nozzle row distance N or equal to or greater than the compliance capacity of the supply flow path 140 of the nozzle row set 23 having the shortest inter-nozzle row distance N.

For example, when the number of the nozzle row sets 23 is three or more, the flow path resistance of the supply flow path 140 corresponding to the nozzle row set 23 other than the nozzle row set 23 having the longest inter-nozzle row distance N and the nozzle row set 23 having the shortest inter-nozzle row distance N may be equal to or greater than the flow path resistance of the supply flow path 140 of the nozzle row set 23 having the longest inter-nozzle row distance N or equal to or less than the flow path resistance of the supply flow path 140 of the nozzle row set 23 having the shortest inter-nozzle row distance N.

Modification Example 10

Although the liquid ejecting apparatus IJP of the embodiment has a configuration in which an ink cartridge as an example of the liquid supply source 110 is mounted on the liquid ejecting head 1 (carriage 3), the present disclosure is not particularly limited thereto. For example, a liquid supply source such as an ink tank may be fixed to the apparatus main body 4 and the liquid supply source and the liquid ejecting head 1 may be coupled via a supply pipe such as a tube. In addition, the liquid supply source may be disposed outside the liquid ejecting apparatus IJP.

Modification Example 11

Although the liquid ejecting head 1 according to the embodiment has the head case 250 holding the head main body 2 and the flow path member 200 is configured to supply ink to the head main body 2 via the head case 250, the present disclosure is not limited thereto. For example, the head main body 2 may be held by the flow path member 200 and ink may be directly supplied from the flow path member 200 to the head main body 2.

Modification Example 12

Although the third vertical flow path 241, the second vertical flow path 512, and the first vertical flow path 511 of the liquid flow path 500 are formed along the Z direction orthogonal to the liquid ejecting surface 20*a* in the embodiment, the present disclosure is not limited to such an aspect. The flow paths may intersect the horizontal direction and may be inclined with respect to the Z direction. Likewise, the branch flow path 531 may be a flow path along a direction intersecting the horizontal direction.

Modification Example 13

The nozzle row 22 may have a configuration in which the plurality of nozzles 21 is arranged along a direction inclined with respect to the transport direction of the medium S (Y direction). In addition, the nozzle row 22 may have a configuration in which the plurality of nozzles 21 is arranged along a direction intersecting both the transport direction of the medium S (Y direction) and the main scanning direction of the carriage 3 (X direction).

Modification Example 14

In the embodiment, the compliance portion 49 is provided on the bottom surface of the common flow path 100 (case member 40). In an alternative configuration, the entire bottom surface of the case member 40 may be covered with the nozzle plate 20. Further, in the nozzle plate 20, the part that overlaps the common flow path 100 in the Z direction may be reduced in thickness to the point of being flexible and the compliance portion 49 may be formed in the common flow path 100 by the nozzle plate 20 reduced in thickness to the point of being flexible. Effects similar to the effects of the embodiment can be obtained in such a configuration.

Modification Example 15

The supply flow paths 140 in the plurality of head main bodies 2 varying in terms of the inter-nozzle row distance N may have the same compliance capacity or the same flow path resistance without exception. In other words, in the supply flow path 140 provided outside the head main body 2, at least one of the compliance capacity and the flow path resistance may be different for each inter-nozzle row distance N.

Modification Example 16

Negative pressure generation sources for forming a meniscus in the nozzle 21 are not limited to the pressure adjustment unit of the present embodiment, which is a valve mechanism provided in the liquid supply source 110. Such a negative pressure generation source for forming a meniscus in the nozzle 21 may be replaced with a water head difference caused by the liquid ejecting surface 20*a* provided with the nozzle 21 being disposed at a position higher than the liquid surface in the liquid supply source 110 in the vertical direction. In an alternative configuration, a porous member such as a sponge may be provided in the liquid supply source 110 and a meniscus may be formed in the nozzle 21 by the capillary force of the porous member.

Modification Example 17

Although the thin film-type piezoelectric actuator 130 has been described as the pressure generating means for causing a change in pressure in the pressure chamber 12, the present disclosure is not particularly limited thereto. Also usable as the pressure generating means are, for example, a thick film-type piezoelectric actuator formed by green sheet attachment or the like, a longitudinal vibration-type piezoelectric actuator in which a piezoelectric material and an electrode forming material are alternately stacked and axially expanded and contracted, one in which a heating element is disposed in a pressure chamber and droplets are ejected from a nozzle by bubbles resulting from heat generation performed by the heating element, and a so-called electrostatic actuator causing droplets to be ejected from a nozzle by generating static electricity between a diaphragm and an electrode and deforming the diaphragm with an electrostatic force.

Modification Example 18

The present disclosure is intended for a wide range of liquid ejecting heads. For example, the present disclosure can also be applied to a recording head such as various ink jet recording heads used in an image recording apparatus such as a printer, a color material ejecting head used in the manufacturing of a color filter such as a liquid crystal display, an electrode material ejecting head used for electrode formation in an organic EL display, a field emission display (FED), and so on, and a biological organic matter ejecting head used for biochip manufacturing.

Content derived from the embodiment will be described below.

The liquid ejecting head of the present application includes a first pressure chamber communicating with a nozzle ejecting a first liquid, a second pressure chamber communicating with a nozzle ejecting a second liquid, a nozzle row in which a plurality of the nozzles is disposed in a first direction, a first supply flow path through which the first liquid is supplied from a first liquid supply source to the first pressure chamber, a second supply flow path through which the second liquid is supplied from a second liquid supply source to the second pressure chamber, a first nozzle row set in which a pair of the nozzle rows is disposed in a second direction intersecting the first direction so that the nozzle rows are symmetrical about a reference line extending in the first direction, and a second nozzle row set in which a pair of the nozzle rows is disposed in the second direction so that the nozzle rows are symmetrical about the reference line and the interval between the nozzle rows is longer than in the first nozzle row set. The plurality of nozzles constituting the first nozzle row set communicates with the first liquid supply source via the first supply flow path. The plurality of nozzles constituting the second nozzle row set communicates with the second liquid supply source via the second supply flow path. Compliance capacity of the second supply flow path is larger than compliance capacity of the first supply flow path.

The first nozzle row set has one first nozzle row first starting ink ejection and the other first nozzle row later starting ink ejection and the one first nozzle row and the other first nozzle row communicate with each other via the first pressure chamber and the first supply flow path. Likewise, the second nozzle row set has one second nozzle row first starting ink ejection and the other second nozzle row later starting ink ejection and the one second nozzle row and the other second nozzle row communicate with each other via the second pressure chamber and the second supply flow path.

The negative pressure that results from liquid ejection by the one first nozzle row first starting liquid ejection is accumulated in the first pressure chamber and the first supply flow path until the other first nozzle row later starting liquid ejection starts liquid ejection. Likewise, the negative pressure that results from liquid ejection by the one second nozzle row first starting liquid ejection is accumulated in the second pressure chamber and the second supply flow path until the other second nozzle row later starting liquid ejection starts liquid ejection.

The interval between the one second nozzle row and the other second nozzle row is longer than the interval between the one first nozzle row and the other first nozzle row. Accordingly, the difference between the timing at which the one second nozzle row starts liquid ejection and the timing at which the other second nozzle row starts liquid ejection (timing difference in the second nozzle row set) is larger than the difference between the timing at which the one first nozzle row starts liquid ejection and the timing at which the other first nozzle row starts liquid ejection (timing difference in the first nozzle row set).

The timing difference in the second nozzle row set is larger than the timing difference in the first nozzle row set. Accordingly, the accumulation of the negative pressure that results from liquid ejection by the one second nozzle row is more enormous than the accumulation of the negative pressure that results from liquid ejection by the one first nozzle row. Accordingly, the other second nozzle row starts liquid ejection in a state where the negative pressure applied to the other second nozzle row is larger than the negative pressure applied to the other first nozzle row.

In the present embodiment, the first supply flow path is provided with a compliance portion alleviating the effect of the negative pressure that results from liquid ejection by the one first nozzle row, the second supply flow path is provided with a compliance portion alleviating the effect of the negative pressure that results from liquid ejection by the one second nozzle row, and the compliance capacity of the second supply flow path is larger than the compliance capacity of the first supply flow path.

Since the compliance capacity of the second supply flow path is larger than the compliance capacity of the first supply flow path, the negative pressure that results from liquid ejection by the one second nozzle row decreases. Then, the accumulation of the negative pressure that results from liquid ejection by the one second nozzle row becomes slight and the other second nozzle row starts liquid ejection in a state where a slight negative pressure is applied. Accordingly, in the other second nozzle row later starting liquid ejection, the liquid is drawn into the nozzle by the negative pressure and the meniscus of the liquid in the nozzle is not damaged. As a result, liquid discharge is stabilized and problems such as defective printing are reduced.

The liquid ejecting head of the present application includes a first pressure chamber communicating with a nozzle ejecting a first liquid, a second pressure chamber communicating with a nozzle ejecting a second liquid, a nozzle row in which a plurality of the nozzles is disposed in a first direction, a first supply flow path through which the first liquid is supplied from a first liquid supply source to the first pressure chamber, a second supply flow path through which the second liquid is supplied from a second liquid supply source to the second pressure chamber, a first nozzle row set in which a pair of the nozzle rows is disposed in a second direction intersecting the first direction so that the nozzle rows are symmetrical about a reference line extending in the first direction, and a second nozzle row set in which a pair of the nozzle rows is disposed in the second direction so that the nozzle rows are symmetrical about the reference line and the interval between the nozzle rows is longer than in the first nozzle row set. The plurality of nozzles constituting the first nozzle row set communicates with the first liquid supply source via the first supply flow path. The plurality of nozzles constituting the second nozzle row set communicates with the second liquid supply source via the second supply flow path. Flow path resistance of the second supply flow path is smaller than flow path resistance of the first supply flow path.

In the other second nozzle row later starting liquid ejection, the phenomenon of liquid drawing into the nozzle and damage to the liquid meniscus in the nozzle depends on the negative pressure that results from liquid ejection by the one second nozzle row or the pressure loss in the second supply flow path, and the phenomenon of damage to the liquid meniscus in the nozzle becomes likely to occur when the negative pressure that results from liquid ejection by the one second nozzle row becomes enormous or when the pressure loss in the second supply flow path becomes enormous.

The pressure loss in the second supply flow path becomes slight when the flow path resistance of the second supply flow path becomes smaller than the flow path resistance of the first supply flow path. Accordingly, the phenomenon of damage to the liquid meniscus in the nozzle becomes less likely to occur in the other second nozzle row later starting liquid ejection than when the pressure loss in the second supply flow path becomes enormous, liquid discharge is unlikely to become unstable, and problems such as defective printing become unlikely to arise.

In the liquid ejecting head described above, compliance capacity of the second supply flow path may be larger than compliance capacity of the first supply flow path.

When a configuration in which the compliance capacity of the second supply flow path communicating with the second nozzle row set having the long nozzle row interval is larger than the compliance capacity of the first supply flow path communicating with the first nozzle row set having the short nozzle row interval is provided in addition to a configuration in which the flow path resistance of the second supply flow path communicating with the second nozzle row set having the long nozzle row interval is smaller than the flow path resistance of the first supply flow path communicating with the first nozzle row set having the short nozzle row interval, the accumulation of the negative pressure that results from liquid ejection by the one second nozzle row becomes even slighter and the other second nozzle row starts liquid ejection in a state where an even slighter negative pressure is applied. Accordingly, in the other second nozzle row later starting liquid ejection, unstable liquid discharge becomes even less likely to arise and problems such as defective printing become even less likely to arise.

The liquid ejecting head described above may further include a head main body provided with the nozzles and a flow path member disposed upstream of the head main body, the first supply flow path may have, in the head main body, a first common flow path communicating with a plurality of the first pressure chambers, the second supply flow path may have, in the head main body, a second common flow path communicating with a plurality of the second pressure chambers, the first common flow path may have a first compliance portion made of a flexible member, the second common flow path may have a second compliance portion made of a flexible member, and an area of the second compliance portion may be larger than an area of the first compliance portion.

When an area of the second compliance portion provided in the second common flow path of the nozzle row set having the long inter-nozzle row distance is larger than an area of the first compliance portion provided in the first common flow path of the nozzle row set having the short inter-nozzle row distance, compliance capacity of the second common flow path of the second nozzle row set having the long inter-nozzle row distance is capable of being larger than compliance capacity of the first common flow path of the first nozzle row set having the short inter-nozzle row distance.

The liquid ejecting head described above may further include a head main body provided with the nozzles and a flow path member disposed upstream of the head main body, the first supply flow path may have, in the head main body, a first common flow path communicating with a plurality of the first pressure chambers, the second supply flow path may have, in the head main body, a second common flow path communicating with a plurality of the second pressure chambers, and a cross-sectional area of the second common flow path may be larger than a cross-sectional area of the first common flow path when seen from the first direction.

When a cross-sectional area of the second common flow path of the second nozzle row set having the long inter-nozzle row distance is larger than a cross-sectional area of the first common flow path of the first nozzle row set having the short inter-nozzle row distance, flow path resistance of the second supply flow path communicating with the second nozzle row set having the long nozzle row interval is capable of being smaller than flow path resistance of the first supply flow path communicating with the first nozzle row set having the short nozzle row interval.

The liquid ejecting head described above may further include a head main body provided with the nozzles and a flow path member disposed upstream of the head main body, and the second supply flow path may have, outside the head main body, a third compliance portion made of a flexible member.

The compliance capacity in the second supply flow path can be further increased when the second supply flow path of the nozzle row set having the long inter-nozzle row distance is provided with the third compliance portion in addition to the second compliance portion.

The liquid ejecting head described above may further include a head main body provided with the nozzles and a flow path member disposed upstream of the head main body, the first supply flow path may include a first liquid flow path provided in the flow path member, the second supply flow path may include a second liquid flow path provided in the flow path member, and the surface of the second liquid flow path perpendicular to the flow direction of the second liquid may be larger in area than the surface of the first liquid flow path perpendicular to the flow direction of the first liquid.

The flow path resistance of the second supply flow path can be smaller than the flow path resistance of the first supply flow path when the surface of the second liquid flow path in the second supply flow path perpendicular to the flow direction of the second liquid is larger in area than the surface of the first liquid flow path in the first supply flow path perpendicular to the flow direction of the first liquid.

In the liquid ejecting head described above, the first supply flow path may have a first filter, the second supply flow path may have a second filter, and the second filter may be larger in area than the first filter.

The flow path resistance of the second supply flow path can be smaller than the flow path resistance of the first supply flow path when the area of the second filter provided in the second supply flow path is larger than the area of the first filter provided in the first supply flow path.

In the liquid ejecting head described above, a color of the first liquid may be different from a color of the second liquid.

In this configuration, the liquid ejecting head has the plurality of nozzle row sets ejecting the liquids of different colors and the nozzle rows as the pair constituting the nozzle row set ejecting the liquid of the same color are arranged so as to be symmetrical about the reference line. Accordingly, when recording operation is performed by the liquid being ejected from the liquid ejecting head while the carriage reciprocates, the order of landing of the liquid of each color with respect to the medium can be aligned in the forward and return paths of the carriage and high-quality printing can be performed.

The liquid ejecting apparatus of the present application includes the liquid ejecting head, a carriage reciprocating in the second direction with the liquid ejecting head mounted, a first liquid supply source in which the first liquid is stored, and a second liquid supply source in which the second liquid is stored.

In the liquid ejecting head, problems such as defective liquid discharge are unlikely to arise in both the second nozzle row set having the long nozzle row interval and the first nozzle row set having the short nozzle row interval. Accordingly, the liquid ejecting apparatus provided with the liquid ejecting head is unlikely to cause problems such as defective liquid discharge and is capable of forming a high-quality image with stability.

What is claimed is:

1. A liquid ejecting head comprising:

a pair of first nozzle rows ejecting a first liquid;

a pair of second nozzle rows ejecting a second liquid;

a first supply flow path for supplying the first liquid from a first liquid supply source to the first nozzles constituting the pair of first nozzle rows; and a second supply flow path for supplying the second liquid from a second liquid supply source to the second nozzles constituting the pair of second nozzle rows, wherein the first nozzle row includes the first nozzles being arranged in a first direction, the second nozzle row includes the second nozzles being arranged in the first direction, the pair of first nozzle rows is disposed in parallel in a second direction intersecting the first direction so that the first nozzle rows are symmetrical about a reference line extending in the first direction, the pair of second nozzle rows is disposed in parallel in the second direction so that the second nozzle rows are symmetrical about the reference line, an interval between the second nozzle rows is longer than an interval between the first nozzle rows in the second direction, and compliance capacity of the second supply flow path is larger than compliance capacity of the first supply flow path.

2. The liquid ejecting head according to claim 1, further comprising:

a first head main body provided with the first nozzles;

a second head main body provided with the second nozzles; and a flow path member disposed upstream of the first head main body and the second head main body, wherein the first supply flow path has, in the first head main body, a first common flow path communicating with the first nozzles, and the second supply flow path has, in the second head main body, a second common flow path communicating with the second nozzles, the first common flow path has a first compliance portion made of a flexible member, the second common flow path has a second compliance portion made of a flexible member, and an area of the second compliance portion is larger than an area of the first compliance portion.

3. The liquid ejecting head according to claim 1, further comprising:

a head main body provided with the first nozzles and the second nozzles; and a flow path member disposed upstream of the head main body, wherein the first supply flow path has, in the head main body, a first common flow path communicating with the first nozzles, and the second supply flow path has, in the head main body, a second common flow path communicating with the second nozzles, the first common flow path has a first compliance portion made of a flexible member, the second common flow path has a second compliance portion made of a flexible member, and an area of the second compliance portion is larger than an area of the first compliance portion.

4. The liquid ejecting head according to claim 1, further comprising:

a first head main body provided with the first nozzles;

a second head main body provided with the second nozzles; and a flow path member disposed upstream of the first head main body and the second head main body, wherein the first supply flow path has, in the first head main body, a first common flow path communicating with the first nozzles, and the second supply flow path has, in the second head main body, a second common flow path communicating with the second nozzles, and a cross-sectional area of the second common flow path is larger than a cross-sectional area of the first common flow path when the second common flow path and the first common flow path are viewed from the first direction.

5. The liquid ejecting head according to claim 1, further comprising:

a head main body provided with the first nozzles and the second nozzles; and a flow path member disposed upstream of the head main body, wherein the first supply flow path has, in the head main body, a first common flow path communicating with the first nozzles, and the second supply flow path has, in the head main body, a second common flow path communicating with the second nozzles, and a cross-sectional area of the second common flow path is larger than a cross-sectional area of the first common flow path when the second common flow path and the first common flow path are viewed from the first direction.

6. The liquid ejecting head according to claim 1, further comprising:

a first head main body provided with the first nozzles;

a second head main body provided with the second nozzles; and a flow path member disposed upstream of the first head main body and the second head main body, wherein the second supply flow path has, outside the first head main body and the second head main body, a third compliance portion made of a flexible member.

7. The liquid ejecting head according to claim 1, further comprising:

a head main body provided with the first nozzles and the second nozzles; and a flow path member disposed upstream of the head main body, wherein the second supply flow path has, outside the head main body, a third compliance portion made of a flexible member.

8. The liquid ejecting head according to claim 1, further comprising:

a first head main body provided with the first nozzles;

a second head main body provided with the second nozzles; and a flow path member disposed upstream of the first head main body and the second head main body, wherein the first supply flow path includes a first liquid flow path provided in the flow path member, the second supply flow path includes a second liquid flow path provided in the flow path member, and an area of the second liquid flow path perpendicular to a flow direction of the second liquid is larger than an area of the first liquid flow path perpendicular to a flow direction of the first liquid.

9. The liquid ejecting head according to claim 1, further comprising:

a head main body provided with the first nozzles and the second nozzles; and a flow path member disposed upstream of the head main body, wherein the first supply flow path includes a first liquid flow path provided in the flow path member, the second supply flow path includes a second liquid flow path provided in the flow path member, and an area of the second liquid flow path perpendicular to a flow direction of the second liquid is larger than an area of the first liquid flow path perpendicular to a flow direction of the first liquid.

10. The liquid ejecting head according to claim 1, wherein the first supply flow path has a first filter, the second supply flow path has a second filter, and an area of the second filter is larger than an area of the first filter.

11. The liquid ejecting head according to claim 1, wherein a color of the first liquid is different from a color of the second liquid.

12. A liquid ejecting apparatus comprising:

the liquid ejecting head according to claim 1;

a first liquid supply source in which the first liquid is stored; and a second liquid supply source in which the second liquid is stored.

13. A liquid ejecting apparatus comprising:

the liquid ejecting head according to claim 2;

a first liquid supply source in which the first liquid is stored; and a second liquid supply source in which the second liquid is stored.

14. A liquid ejecting apparatus comprising:

the liquid ejecting head according to claim 3;

a first liquid supply source in which the first liquid is stored; and a second liquid supply source in which the second liquid is stored.

15. A liquid ejecting apparatus comprising:

the liquid ejecting head according to claim 4;

a first liquid supply source in which the first liquid is stored; and a second liquid supply source in which the second liquid is stored.

16. A liquid ejecting apparatus comprising:

the liquid ejecting head according to claim 5;

a first liquid supply source in which the first liquid is stored; and a second liquid supply source in which the second liquid is stored.

* * * * *